US006694695B2

(12) United States Patent
Collins et al.

(10) Patent No.: US 6,694,695 B2
(45) Date of Patent: Feb. 24, 2004

(54) WALL STUD SPACER SYSTEM WITH SPACER RETAINERS

(75) Inventors: John J. Collins, Chagrin Falls, OH (US); Larry R. Daudet, Porter, IN (US); Gregory S. Ralph, Gibsonia, PA (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/940,051

(22) Filed: Aug. 27, 2001

(65) Prior Publication Data

US 2003/0037494 A1 Feb. 27, 2003

(51) Int. Cl.[7] ..... E04B 2/60
(52) U.S. Cl. ..... 52/568; 52/653.1; 52/656.1
(58) Field of Search ..... 52/656.1, 653.1, 52/655.2, 568, 570; 403/315, 316, 317

(56) References Cited

U.S. PATENT DOCUMENTS

| | | | | |
|---|---|---|---|---|
| 894,711 A | | 7/1908 | Worcester | |
| 992,941 A | | 5/1911 | Danielson | |
| 1,101,745 A | | 6/1914 | Jones | |
| 1,346,426 A | | 7/1920 | Scherbner | |
| 1,603,678 A | | 10/1926 | Furey | |
| 1,656,741 A | | 1/1928 | Lane | |
| 1,791,197 A | * | 2/1931 | Dickson | 52/342 |
| 2,245,908 A | | 6/1941 | Drake | |
| 2,430,654 A | | 11/1947 | Voege | |
| 2,918,995 A | | 12/1959 | Kruger | |
| 3,010,162 A | | 11/1961 | Klein | |
| 3,201,874 A | | 8/1965 | Christy | |
| 3,305,981 A | | 2/1967 | Biggs et al. | |
| 3,322,447 A | | 5/1967 | Biggs | |
| 3,374,591 A | | 3/1968 | Tillisch et al. | |
| 3,482,369 A | * | 12/1969 | Burke | 52/669 |
| 3,562,970 A | | 2/1971 | Schwartz | |
| 3,653,172 A | * | 4/1972 | Schwartz | 52/669 |

(List continued on next page.)

FOREIGN PATENT DOCUMENTS

| | | |
|---|---|---|
| AU | 30388 | 10/1972 |
| GB | 593443 | 10/1947 |
| GB | 2103264 A | 2/1983 |
| WO | WO 93/24712 | 12/1993 |
| WO | WO 96/23945 | 10/1996 |
| WO | PCT/US00/11991 | 11/2000 |

OTHER PUBLICATIONS

"Don't Just Space It, Brace–It", brochure, publication date unknown, Truswal Systems, Arlington, Texas.
U.S. patent application Ser. No. 10/383,047, Brunt, (unpublished).
U.S. patent application Ser. No. 10/641,062, Elderson, (unpublished).

*Primary Examiner*—Carl D. Friedman
*Assistant Examiner*—Basil Katcheves
(74) *Attorney, Agent, or Firm*—Kirkpatrick & Lockhart LLP

(57) ABSTRACT

Wall constructions and methods for constructing walls. In one embodiment, the wall is constructed from studs that each having a web that has at least one opening therein. The studs are oriented such that the openings in their webs are aligned to permit at least one spacer member to extend therethrough. The spacer members are formed with structure for engaging portions of the webs through which they extend. Retainers are provided on the webs of the studs for retaining the spacer members in position. In another embodiment at least two studs that have webs with openings therethrough are oriented such that the openings are aligned with each other. At least one spacer member is inserted through the aligned openings to engage a portion of each web through which they extend. The spacers are then brought into engagement with retainers on the webs of the studs.

42 Claims, 32 Drawing Sheets

U.S. PATENT DOCUMENTS 4,018,020 A 4/1977 Sauer et al.
4,031,594 A 6/1977 Cepuritis
4,036,307 A 7/1977 Marais
4,043,689 A 8/1977 Spencer et al.
4,075,810 A 2/1978 Zakrzewski et al.
4,208,851 A 6/1980 Sauer
4,225,265 A 9/1980 Hooker et al.
4,235,054 A 11/1980 Cable et al.
4,246,736 A 1/1981 Kovar et al.
4,426,822 A 1/1984 Gailey
4,448,004 A 5/1984 Thorsell
4,522,009 A 6/1985 Fingerson
4,604,845 A * 8/1986 Brinker ..... 52/696
4,693,047 A * 9/1987 Menchetti ..... 52/664
4,727,704 A 3/1988 Carlton
4,791,766 A 12/1988 Egri, II
4,809,476 A 3/1989 Satchell
4,840,005 A 6/1989 Cochrane
4,850,169 A 7/1989 Burkstrand et al.
4,858,407 A 8/1989 Smolik
4,860,791 A 8/1989 Putnam
4,914,878 A 4/1990 Tamaki et al.
5,127,760 A 7/1992 Brady
5,155,962 A 10/1992 Burkstrand et al.
5,197,247 A 3/1993 Elderson
5,274,973 A 1/1994 Liang
5,287,664 A 2/1994 Schiller et al.
5,488,198 A 1/1996 Kramer
5,720,138 A 2/1998 Johnson
5,784,850 A * 7/1998 Elderson ..... 52/667
5,822,942 A 10/1998 Lucia, Jr.
5,870,874 A 2/1999 Brothers
5,904,023 A 5/1999 DiGirolamo et al.
5,964,071 A * 10/1999 Sato ..... 52/656.1
6,021,618 A * 2/2000 Elderson ..... 52/667
6,241,199 B1 6/2001 Ismert
6,301,854 B1 * 10/2001 Daudet et al. ..... 52/650.1
2002/0059773 A1 5/2002 Elderson
2003/0089053 A1 5/2003 Elderson
2003/0106280 A1 6/2003 diGirolamo

* cited by examiner

WALL STUD SPACER SYSTEM WITH SPACER RETAINERS

CROSS-REFERENCE TO RELATED APPLICATIONS

Not applicable.

FEDERALLY SPONSORED RESEARCH

Not applicable.

BACKGROUND OF THE INVENTION

Field of the Invention

The subject invention relates to structures and, more particularly, to walls constructed from metal studs and methods of constructing walls utilizing metal studs.

DESCRIPTION OF THE INVENTION BACKGROUND

Background of the Invention

Metal studs are commonly used today to form walls in building structures. In a typical installation, the metal studs are secured by screws at their lower ends to a bottom track secured to a floor and at their upper ends to a top track secured to overhead joists which may form the framework for an upper floor. Wallboards or other panels are applied to the sides of the studs to form a closed wall structure. A problem with this arrangement is that deflection of the overhead joists under loads is translated into vertical loads acting on the studs. These vertical loads may cause bowing or other flexing of the metal studs which may cause the walls to crack or otherwise be flawed or damaged.

Deflection track wall systems have been used in the past to combat the problem of wall bowing and/or cracking arising from overhead loads being applied to the vertical studs in a non-load bearing wall. Three known deflection track wall systems are commonly referred to as the crimped track system, the double track system, and the track and brace system.

In the crimped stud system, the top track has a horizontal crimp in each flange thereof. This permits relative vertical movement between the upper and lower portions of each flange of the top track. Accordingly, the metal studs can be fastened to the lower portions of the flanges of the top track while the crimps in the flanges accommodate vertical deflections of the overhead structure to which the web of the top track is secured.

In the double track system, two top tracks are nested one within the other. The larger or upper track is attached to the overhead joists or other overhead structure. The smaller or lower track is nested within the larger rack and has attached thereto the upper ends of the metal studs. There is a gap between the webs of the two tracks that permits vertical movement of the larger track without corresponding movement of the smaller track.

The track and brace system uses a horizontal brace which spans two or more metal studs. The brace extends through a conduit hole in the web of each metal stud and is fastened to an L-shape clip that in turn is fastened to the stud. The brace eliminates the need to fasten the upper ends of the metal studs to the top track which is then free to move vertically without imparting vertical loads in the metal studs.

The installation of metal stud wall systems, including deflection track wall systems, is generally a very time consuming process. In a typical installation where the metal studs are fastened at their upper ends to a top track or channel, the attachment positions of the studs are marked off along the top track. Then each stud is fastened to each flange of the top track by screws. Often a ladder must be used because the top track is too high for the installer to reach. The installer climbs the ladder and fastens as many studs that he can reach to the near flange of the top track. Then the ladder must be moved to enable the installer to affix additional studs to the top track. After doing this along one side of the wall, the process is repeated on the other side of the wall to fasten the studs to the other flange of the top track. A similar process is used to install a track and brace wall system, except that the fastening positions of the metal studs are usually marked off along the brace. Also, only one pass is needed to fasten the stud clips to the brace. Although less time consuming in these respects, the time savings is more than offset by the time expenditure or cost associated with fastening the stud clips to the metal studs.

The stud wall spacers disclosed in U.S. Pat. No. 5,784,850 to Elderson and U.S. Pat. No. 6,021,618 to Elderson disclose stud wall spacers and methods that represent a vast improvement over the above-mentioned approaches. When utilizing the spacer members disclosed in those patents, it may be advantageous to provide a means for further retaining the spacer bars in position and to prevent their easy removal after they have been installed. It may be further advantageous to provide such a means that does not require the installer to drill separate holes into the stud or to use other tools other than the tools used to install the spacer. It may also be advantageous to provide such a means that will operate regardless of the vertical orientation of the stud.

SUMMARY OF THE INVENTION

In accordance with one embodiment of the present invention there is provided a wall that includes at least two studs wherein each stud has a web portion with an opening therethrough. An elongated spacer member extends through the opening in the webs of at least two studs. The spacer member has at least one stud engager thereon that corresponds to each web. The wall further includes at least one spacer retainer on each web in retaining engagement with a corresponding stud engager on the elongated spacer member.

Another embodiment of the present invention comprises a wall that includes at least two studs wherein each stud has a web portion with an opening therethrough. An elongated spacer member extends through the opening in the webs of at least two studs. The elongated spacer member has at least one stud engager thereon that corresponds to each web for retaining engagement therewith. The wall further includes at least one spacer retainer formed on each web for retaining the spacer member within the openings in the studs through which the spacer member extends.

Another embodiment of the present invention comprises a wall that includes a bottom track and at least two structural studs that each has a web with at least one opening therethrough. Each opening has an upper end and a lower end and the structural studs are affixed to the bottom track such that at least one opening in the web of one structural stud is in alignment with an opening in the web of another structural stud. The wall also includes at least one elongated spacer member that extends through the bottom end of at least two aligned openings in the webs of the structural studs. Each elongated spacer member has at least one notch formed therein that corresponds to the web openings through which the elongated spacer member extends. A dimple is provided on the web of each stud and is oriented adjacent to the lower end of the opening therein for retaining engagement with a corresponding notch in the spacer member.

Another embodiment of the present invention comprises a wall that includes a bottom track and at least two structural studs that each has a web with at least one opening therethrough. Each opening has an upper end and a lower end. The structural studs are affixed to the bottom track such that a least one opening in the web of one structural stud is in alignment with an opening in the web of another structural stud. At least one elongated spacer member extends through the bottom end of at least two aligned openings in the webs of the structural studs. Each elongated spacer member has at least one notch formed therein corresponding to the web openings through which the elongated spacer member extends. A dimple is provided on the web of each stud and is oriented adjacent to the lower end of the opening therein for retaining engagement with a corresponding notch in the spacer member.

Another embodiment of the present invention may comprise a wall that includes at least two structural studs that each has a web with at least one opening therethrough. Each opening has two lateral sides. The structural studs are affixed to the bottom track such that at least one opening in the web of one structural stud is in alignment with an opening in the web of another structural stud. At least one elongated spacer member extends through the bottom end of at least two aligned openings in the webs of the structural studs. Each elongated spacer member has at least one notch formed therein corresponding to the web openings through which the elongated spacer member extends. The wall further comprises an elongated dimple on each web adjacent each lateral side of the opening therein for retaining engagement with a corresponding notch in the spacer member.

Another embodiment of the present invention comprises a method for constructing a wall which includes affixing at least two studs each having a web portion with at least one opening therethrough to a track such that at least one opening in the web of one stud is aligned with an opening in at least one other stud and inserting a spacer member through at least two aligned openings. The method further includes engaging the spacer member with corresponding spacer retainers on the webs of the studs through which the spacer member extends.

Another embodiment of the present invention comprises a method for constructing a wall which includes affixing the lower end of a first stud to a track wherein the first stud has a web with at least one opening therethrough. The method further includes affixing an upper end of a second stud to the track such that an opening in a web of the second stud is in alignment with the opening in the web of the first stud. In addition, a spacer member is inserted through the aligned openings in the first and second studs and the spacer member is brought into engagement with corresponding spacer retainers on each of the webs of the first and second studs.

Accordingly, the present invention further augments the advantages provided when utilizing spacer members for spacing and retaining studs in various construction settings and applications. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
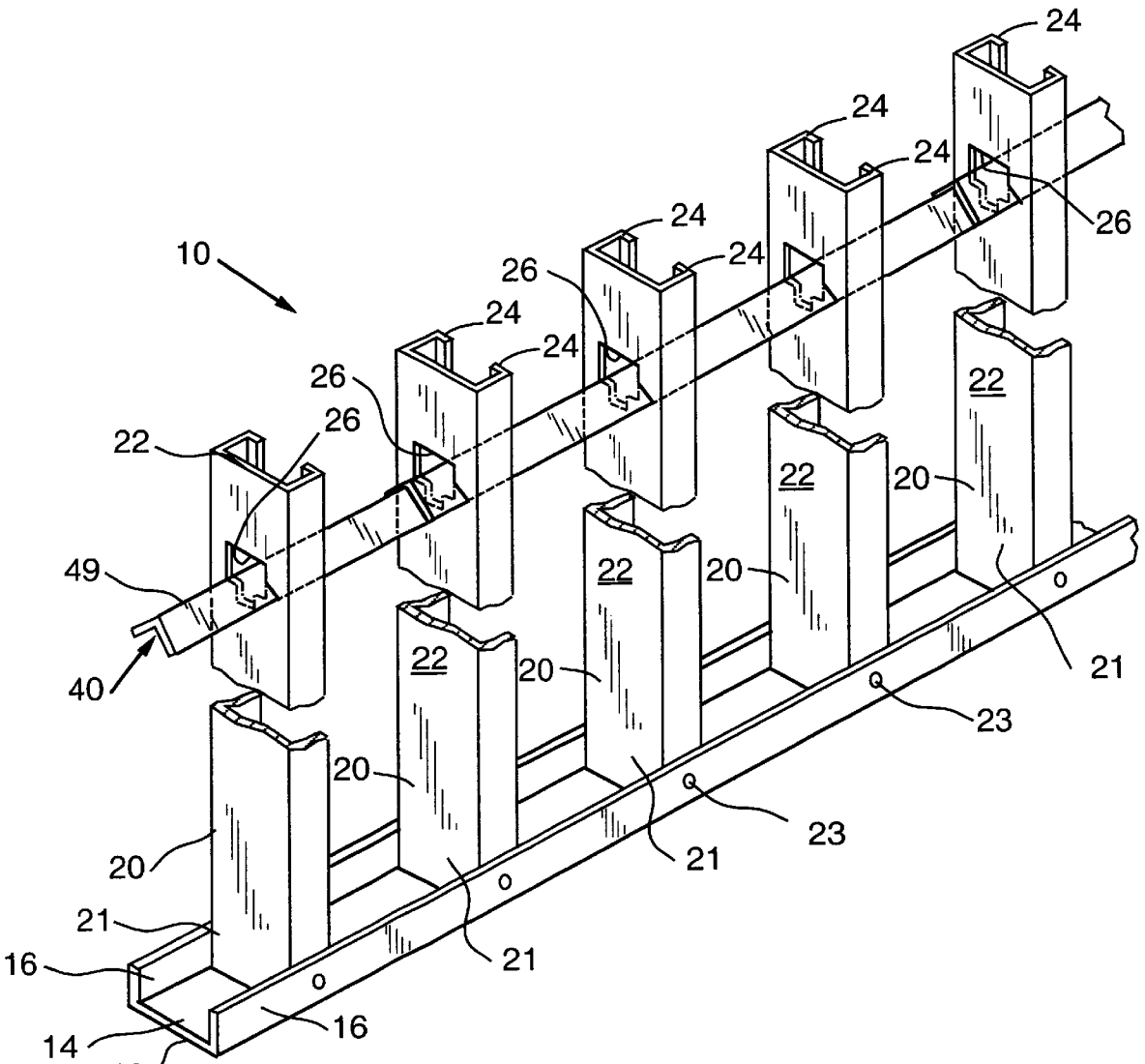
FIG. 1 is a perspective view of a metal stud wall employing a spacer member and studs of one embodiment of the present invention.

Referring now to the drawings for the purposes of illustrating the present preferred embodiments of the invention only and not for the purposes of limiting the same, FIG. 1 illustrates a metal stud wall "skeleton" 10 fabricated in accordance with one embodiment of the present invention. In this embodiment, the metal stud wall skeleton 10 includes a lower track 12, a plurality of metal studs 20, and at least one spacer member 40. Wall panels, such as wallboard, may be secured in well-known manner to one or both sides of the metal studs 20 to close the wall and form the exterior surface or surfaces of the wall. As the present Detailed Description proceeds, those of ordinary skill in the art will appreciate that the various embodiments of the present invention could be successfully employed regardless of the orientation of the wall.

In this embodiment, the studs 20 are generally C-shaped. More particularly, the studs 20 have a web 22 and a pair of L-shaped flanges 24 perpendicular to the web 22. There are also one or more openings 26 in the web 22. Those of ordinary skill in the art will appreciate that the openings 26 heretofore have been provided in metal studs to permit electrical conduit and plumbing to be run within the stud wall. Since the openings 26 are located in the same position in the individual studs forming the wall as is conventional, the openings 26 are horizontally aligned with each other as shown in FIG. 1.

In the assembly of the metal stud wall 10, the metal studs 20 are secured at one end 21 thereof to bottom track 12 by conventional fasteners 23 such as, for example, screws, rivets, etc. The bottom track 12 is also C-shaped with a central web portion 14 and two legs 16 protruding therefrom. In conventional construction situations, the web 14 of the bottom track 12 is commonly affixed to the floor with conventional fasteners such as screws, bolts, rivets, etc.

A stud spacer member 40 is inserted through the aligned openings 26 provide through the webs 22 of the respective studs 20 such that the notches 42 in the stud spacer member 40 are aligned with the web 22 of respective studs 20, or vice versa. As will be discussed in further detail below, the stud spacer member 40 also functions to maintain the metal studs 20 at the prescribed spacing as during application of the wall panels to the studs 20 thereby eliminating the need to secure the top or another end 25 of each stud 20 to an upper channel or header (not shown). Although the wall panels once applied may maintain the spacing of the metal studs as well, the stud spacer member 40 may still function to assist in resisting relative movement of the metal studs 20 in the plane of the wall and to resist bowing of the studs 20. In addition, the stud spacer member also effectively prevents the torsional rotation of the studs 20. In fact, additional spacer members 40 may be provided at different heights to add strength to the metal stud wall skeleton 10.

Figure 3:
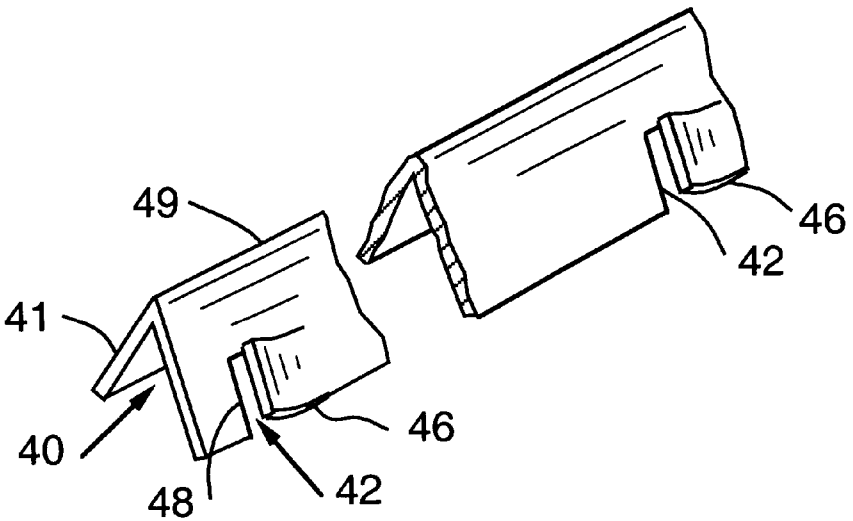
FIG. 3 is a perspective view of a stud spacer member.
Figure 4:
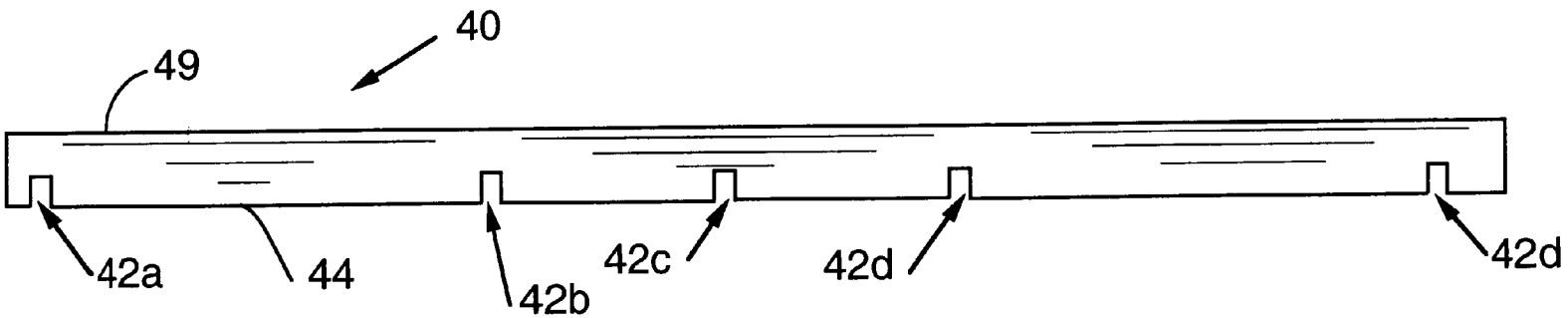
FIG. 4 is a side view of a stud spacer member.

One spacer member configuration is shown in FIGS. 3 and 4. As can be seen in those Figures, stud spacer member 40 comprises an elongated bar member 41 which is generally V-shaped in cross-section along its length. The V-shape functions to rigidify the elongated bar member 41 against lateral flexure, i.e., flexure perpendicular to the longitudinal axis of the stud spacer member 40 and prevent the torsional rotation of the studs. The V may have an included angle in the range of about 45° to 135°, or about 60° to 120° or about 90°.

The elongated member 41 need not necessarily be V-shaped as shown in FIG. 3. The elongated member 30 alternatively could be generally planar with one or more bosses running (and overlapping if plural bosses are provided) the length of the elongated member 41. The boss or bosses (deflected out of the planar portions of the elongate member) would serve to rigidify the elongated member 41. Of course, other means may be provided to rigidify the elongate member 41 against lateral flexure, such as the use of stiffening ribs, a thicker stock, etc.

In the embodiment depicted in FIG. 3, notches 42 are provided in each planar side portion of the V-shaped elongated member 41 with the notches 42 opening to the longitudinal outer edge 44 of the respective side portion. The notches 42 have a "stud engager" portion or "stud engagement means" for engaging a portion of the web 22. In one embodiment, the stud engagers or stud engagement means comprises a resiliently flexible tab or flap 46 formed on one side of the notch 42 that functions to resiliently bias the web 22 against an abutment 48 formed by the opposite side of the notch 42. The flap 46 may be formed by bending a portion of the respective side portion of elongated member 41 out of the plane of the side portion. The opposite edge of the notch 42 preferably remains in the plane of the relatively adjacent region of the side portion to form a positive positioning stop or abutment 48 perpendicular to the longitudinal axis of the elongated member 41 against which the web 22 of the stud 20 will be held by the flexible flap 46. The corners of the flap 46 at its free end may be relatively sharply angled, as at an included angle of 60 degrees or less, to form a barb for engaging a portion of the stud web.

Although the notches 42 are shown disposed along the outer edge 44 of each side portion, it should be realized that the notches 42 could be formed elsewhere, such as along the crease 49 of the V-shaped elongated member 41. However, in this embodiment, the notches 42 open to the outer edge of each side portion, with the notches 42 of one side portion being laterally aligned with corresponding notches of the other side portion. The pairs of laterally spaced notches 42, as opposed to a single notch, provide two points of contact for the stud spacer member 40. The two points of contact aid in preventing the studs 20 from pivoting or twisting, thus adding greater stability to the wall 10.

The stud spacer member 40 depicted in FIG. 4 includes four notches 42*a*–42*d* spaced at 16 inch (40.6 cm) intervals, and one notch 42*e* equally spaced between the two central notches 42*b* and 42*c*. This particular arrangement of notches 42 creates a stud spacer member 40 which can be used in metal stud walls 10 which have a stud spacing of either 16 inches (40.6 cm) or 24 inches (61 cm). If the wall 10 is to have a stud spacing of 16 inches (40.6 cm), notches 42*a*–42*d* engage the webs 22 of the studs 20. If the wall 10 is to have a stud spacing of 24 inches (61 cm), notches 42*a*, 42*d*, and 42*e* engage the webs 22 of the studs 20. Those of ordinary skill in the art will of course appreciate that the notches 42*a*–42*e* may be so oriented to accommodate essentially any desired stud spacing arrangement, for example, wherein the webs 22 of the studs 20 are to be spaced at twelve inch (30.5 cm) intervals.

The distance between abutments 48 will equate to a distance between webs 22 of the studs 20 which form the skeleton of the wall 10, as the flap 46 will force the web 22 against the abutment 48. As will be appreciated, the distance between the cuts that form the abutments 48 and flaps 46 can be controlled within relatively tight tolerances and this translates to accurate spacing of the studs 20 in a row thereof forming a wall. With one stud 20 plumbed and fixed in place, all of the other studs 20 will be held plumb by the spacer member 40 or chain of overlapping spacer members 40.

For example, in the United States, walls 10 are generally constructed with studs spaced on 16 inch (40.6 cm) or 24 inch (61 cm) centers. Therefore, a cut in the elongate member 41 will be made at 16 (40.6 cm) or 24 (61 cm) inch intervals, thus ensuring that the web-to-web spacing of the studs 20 will be 16 inches (40.6 cm) or 24 inches (61 cm).

In one embodiment, the overall length of a stud spacer member 40 is about 50 inches (127 cm). The spacer member 40 is also sufficiently narrow to fit within the dimensioned so that it may be received in the reduced width conduit slot forming the lower portion of the stud opening as is often provided in the metal studs to centrally space conduit between the outer side edges of the metal studs. The metal which forms the stud spacer member 40 may have a thickness ranging, for example, from about 22 gauge to 16 gauge. In one embodiment, the stud spacer member 40 is constructed from 16 gauge metal, which has a thickness of 0.0538 inch (0.165 cm). In another embodiment, the stud spacer member is fabricated from 20 gauge metal, which has a thickness of about 0.0329 inch (0.1 cm).

Figure 5:
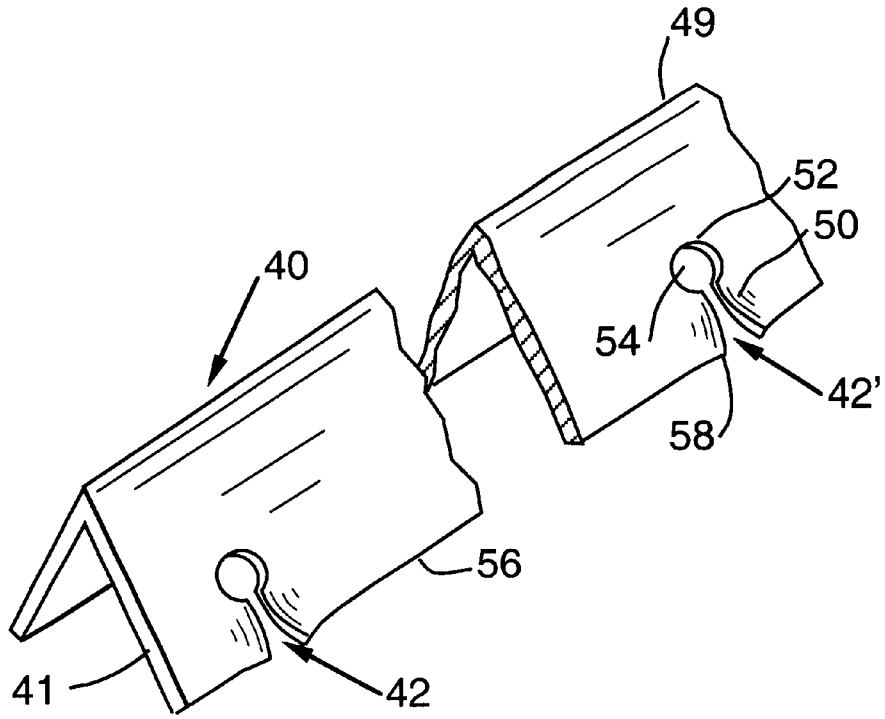
FIG. 5 is a perspective view of another spacer member.

Another form of notch 42' has a slot portion 50 and a relatively wider inner portion 52. See FIG. 5. The slot portion 50 extends from the enlarged inner portion 52 to the outer longitudinal edge 44. The distinct transition from the slot portion 50 to the enlarged inner portion 52 forms angled shoulders 54 which "bite" into the metal of the web 22 thereby retaining the web 22 in the notch 42'. The slot portion 50 of the notch 42' may have a width that corresponds to and may be slightly less than the thickness of the metal forming the web 22, so that the slot portion 50 fits tightly over the web 22. The enlarged inner portion 52 and the outer longitudinal edge of the side portion 56 define therebetween a resilient flap portion of the side portion that can flex away from opposed flap portion to receive therebetween the web 22 of the stud 20. The outer corners of the opposed flap portions are flared slightly out of the plane of the side portion to form slightly outturned ears 58 that define therebetween a widened mouth for receiving and guiding the web 22 of the stud 20 into the narrower through section of the slot portion 50.

Figure 2:
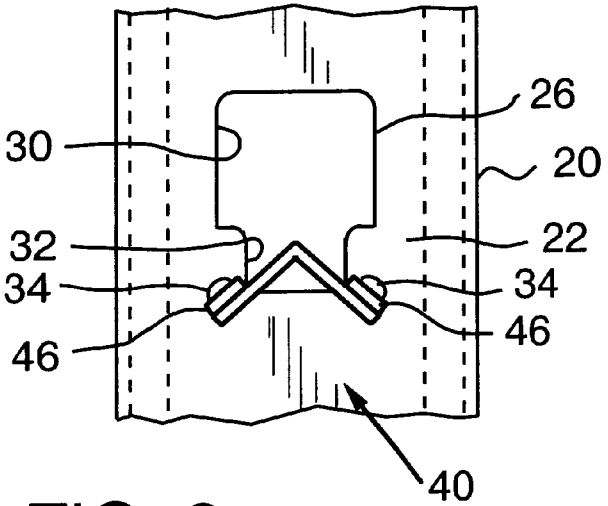
FIG. 2 is a partial view of the spacer and one stud depicted in FIG. 1.
Figure 6:
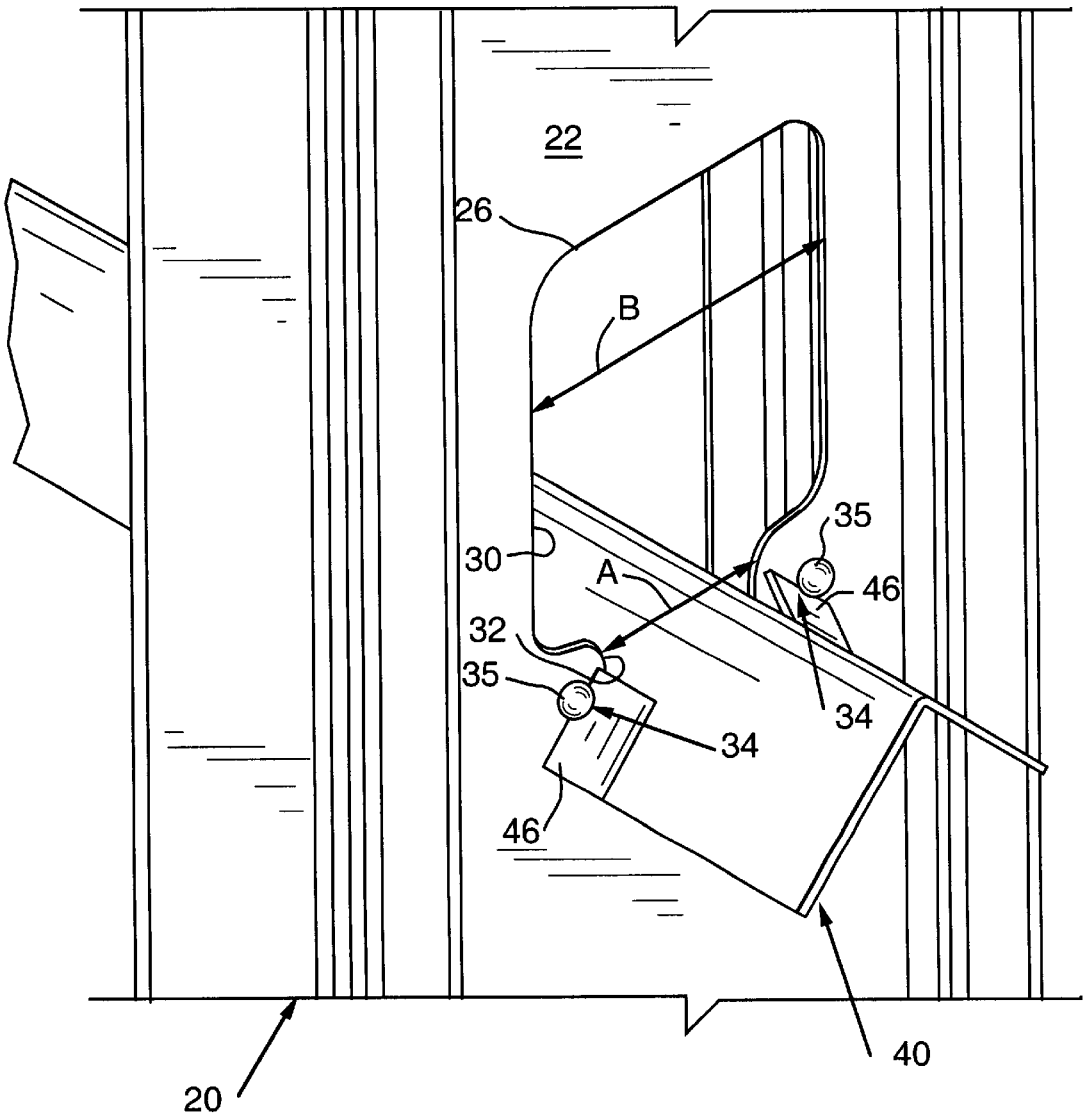
FIG. 6 is a partial perspective view of the spacer member and stud depicted in FIGS. 1 and 2.

The embodiment depicted in FIGS. 1, 2, and 6, includes drywall studs 20 that have an opening 26 in the stud web 22 that has an upper portion 30 and a lower portion 32. The width of the lower portion 32 (distance "A") is smaller than the width of the upper portion 30 (distance "B"). The spacer member 40 is sized to be received in the lower portion 32 of the opening 26. In this embodiment, at least one and, as shown in FIGS. 1, 2, and 3, two "spacer retainers" or "spacer retaining means" 34 are provided in the portions of the web adjacent to the points of intersection wherein the lower portion of the opening meets the upper portion of the opening. In this embodiment, the spacer retainers 34 are formed in the web and comprise hemispherically shaped dimples 35. The dimples 35 may be integrally formed in the web 22 of the stud 20 with conventional metal forming processes and techniques, or they may be otherwise attached to the web with appropriate fasteners. For example, it is conceivable that the dimples 35 may be fabricated from metal and be welded, brazed, soldered, etc. to the web 22 or attached with screws, etc. The dimples 35 could also conceivably be fabricated from other material such as rubber, plastic, etc. and be attached to the web 22 with appropriate adhesive or other mechanical fasteners such as screws or the like.

Figure 7:
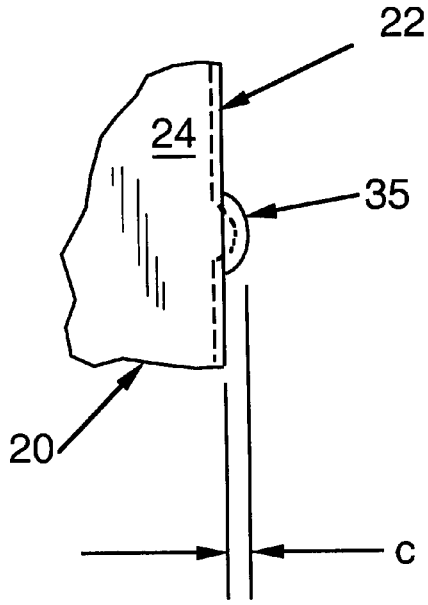
FIG. 7 is a partial view of the stud depicted in FIG. 6.
Figure 8:
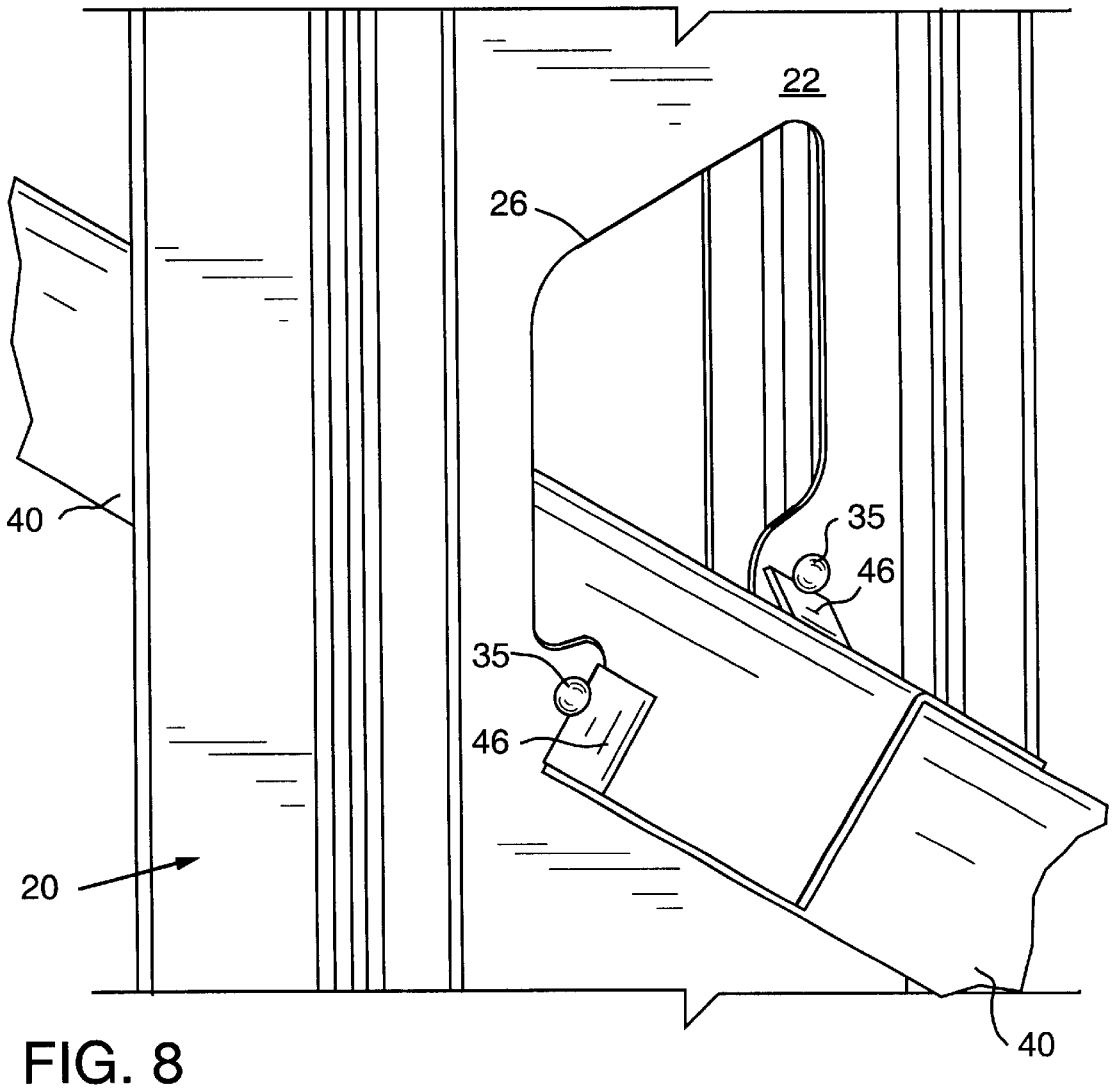
FIG. 8 is a partial perspective view of a pair of overlapping spacer members and a stud of the type depicted in FIGS. 1 and 6.

In this embodiment, the dimples 35 are sized and located such that when the spacer bar member 40 is installed as shown in FIGS. 1, 2, and 6, the ends of the flaps 46 of the spacer bar 40 engage or essentially "bite" into the dimples thereby retaining the web 22 in the notch 42. In this embodiment, the notch 42 has a width which corresponds to and preferably is slightly less than the thickness of the metal forming the web 22. In addition, the dimples protrude a distance from the web 22 (distance "C" in FIG. 7) and may have a diameter of approximately 1/16–1/4 inches (0.16–0.63 cm), so that the corresponding flap 46 retainingly engages the dimple 35 to retain the spacer bar 40 in retaining engagement with the web 22 of the stud 20. Those of ordinary skill in the art will appreciate that, if desired, only one notch 42 which corresponds to a particular stud 20 may be provided and therefore the stud 20 may be provided with a single dimple 35 oriented for retaining engagement with the flap portion 46 of the notch 42 when the spacer bar is seated within the lower portion 32 of the opening 26. If desired, a pair of spacer bars 40 may be overlapped as shown in FIG. 8. In that embodiment, the dimples 35 are located for retaining engagement with the flaps 46 of the uppermost spacer bar 40.

Figure 9:
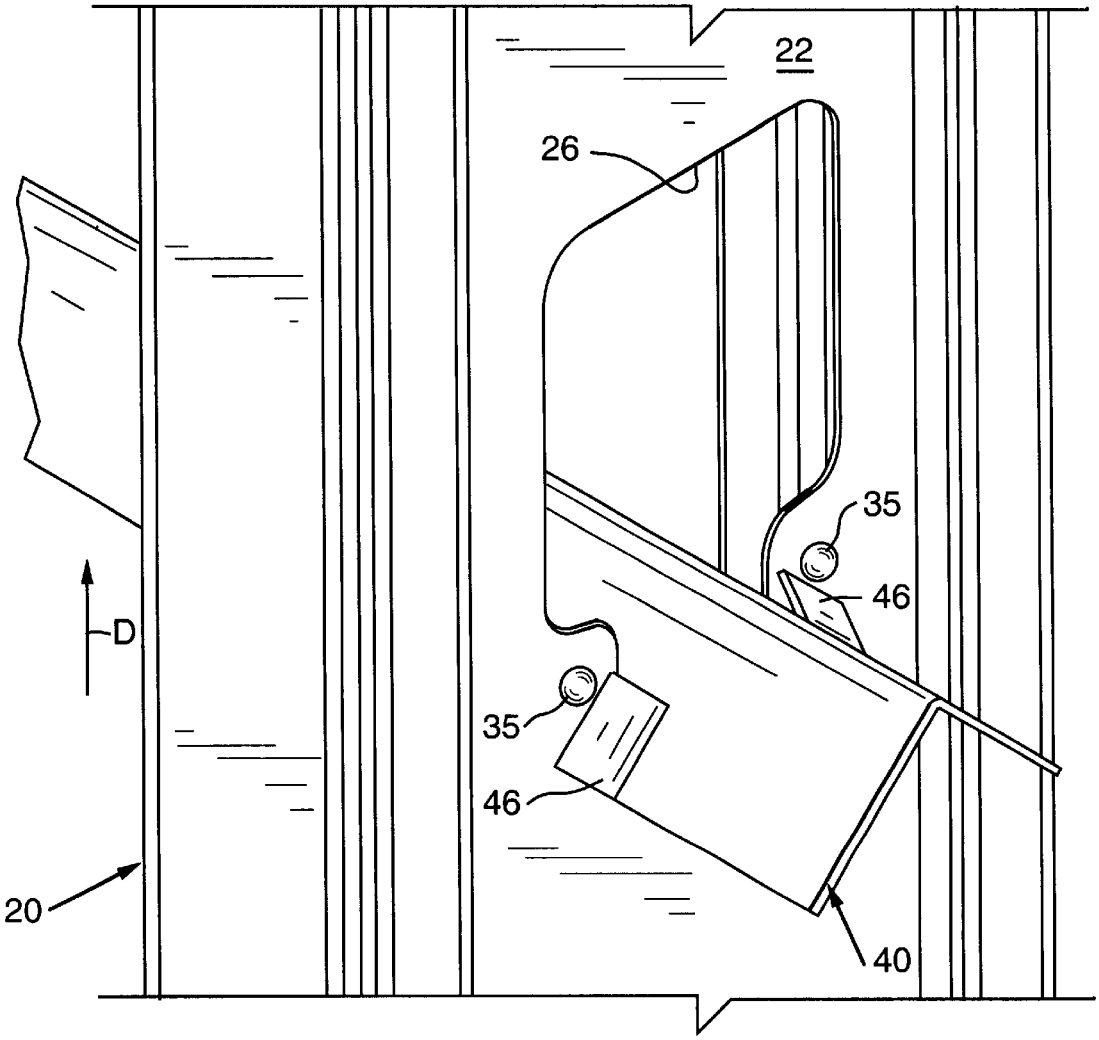
FIG. 9 is a partial perspective view of a spacer member and another drywall stud of the present invention.

In the embodiment depicted in FIG. 9, the dimples 35 are oriented such that when the spacer bar 40 is installed as shown (i.e., in seated engagement within the lower portion 32 of the opening 26) the flaps 46 are not in engagement with the dimples 35, but instead engage portions of the web 22 beneath the dimples 35. In this embodiment, the spacer bar 40 is moved downwardly into the lower portion 32 of the opening, by tapping the spacer bar 40 into position. The width of the notch 42 must be sufficient to permit the flaps 46 to be biased over the dimples 35 when the bar 40 is being installed. Once installed in the position as shown in FIG. 9, the dimples 35 would retard the inadvertent upward movement (direction represented by arrow "D") to prevent the removal of the spacer bar 40 from the stud 20.

Figure 10:
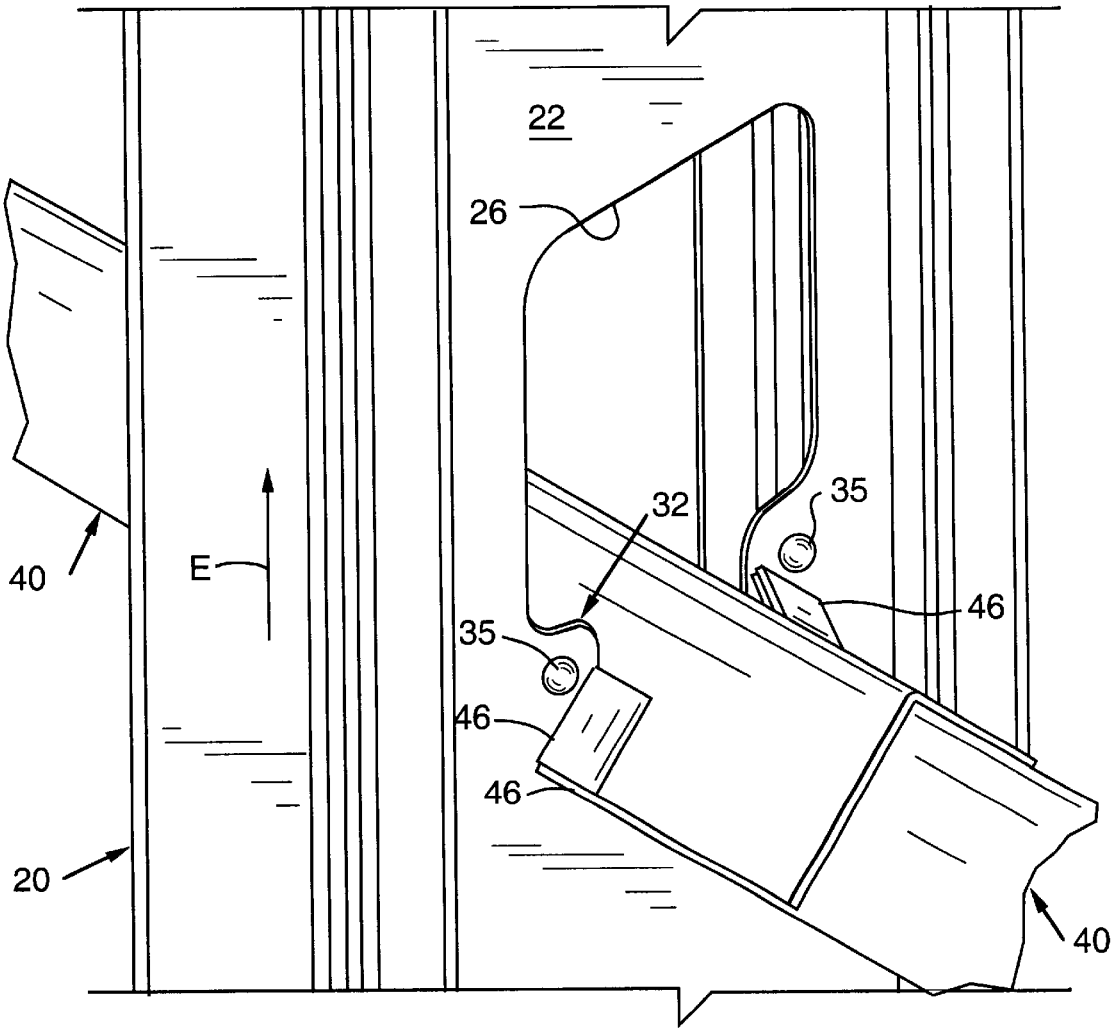
FIG. 10 is a partial perspective view of a pair of overlapping spacer members and the drywall stud depicted in FIG. 9.

FIG. 10 depicts the use of two overlapped spacer bars 40. In that embodiment, the dimples 35 are located relative to the flaps 46 of the uppermost spacer bar 40 such that the flaps 46 do not engage the dimples 35, but the dimples 35 would prevent easy detachment of the spacer bars 40 from the web 22 of the stud 20.

Figure 11:
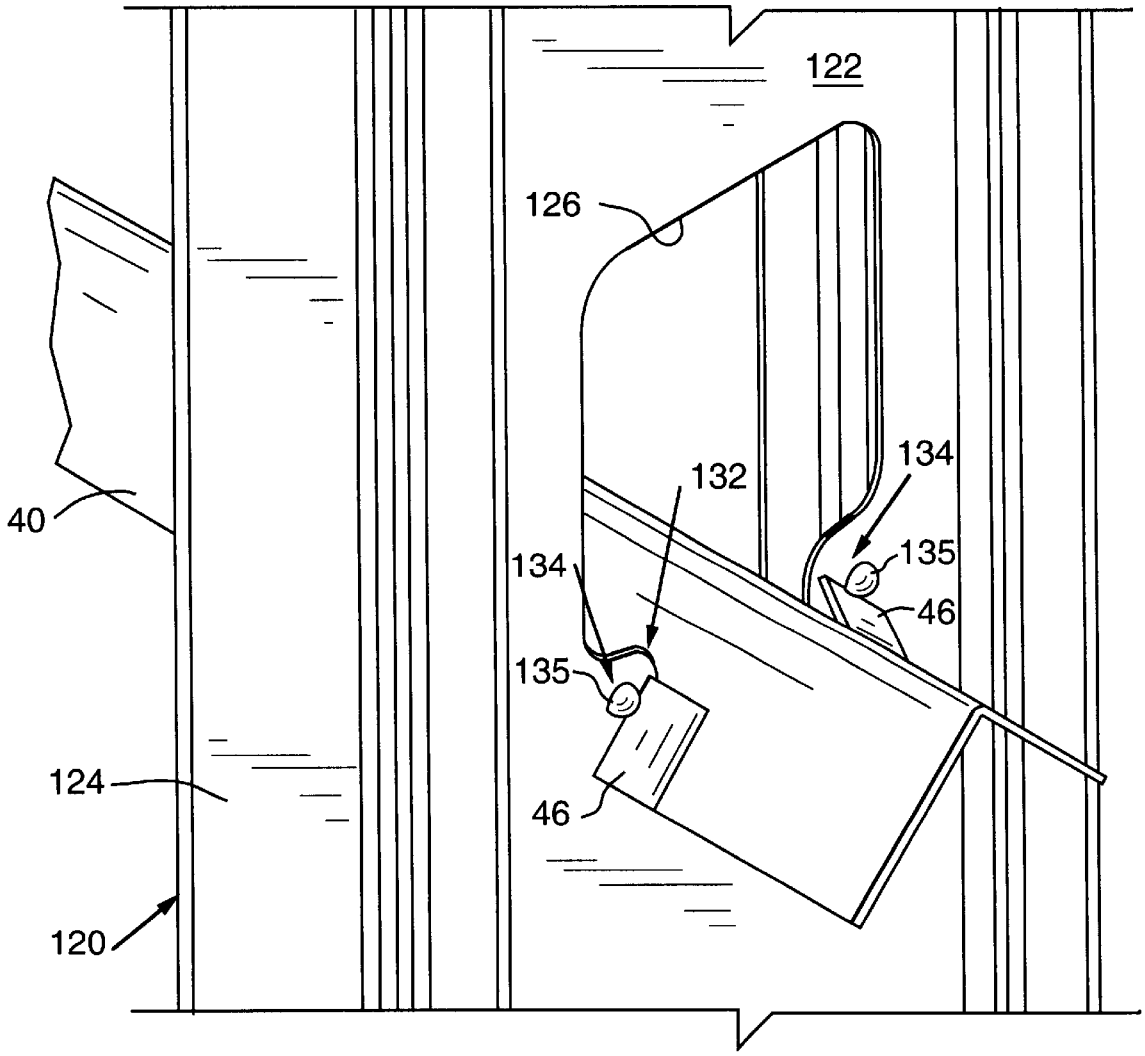
FIG. 11 is a partial perspective view of a spacer member and another drywall stud of the present invention.
Figure 12:
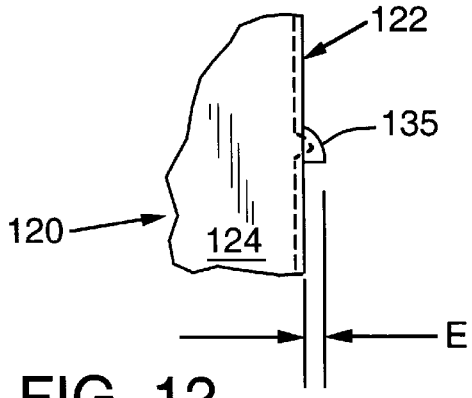
FIG. 12 is a partial view of the stud of FIG. 11.
Figure 13:
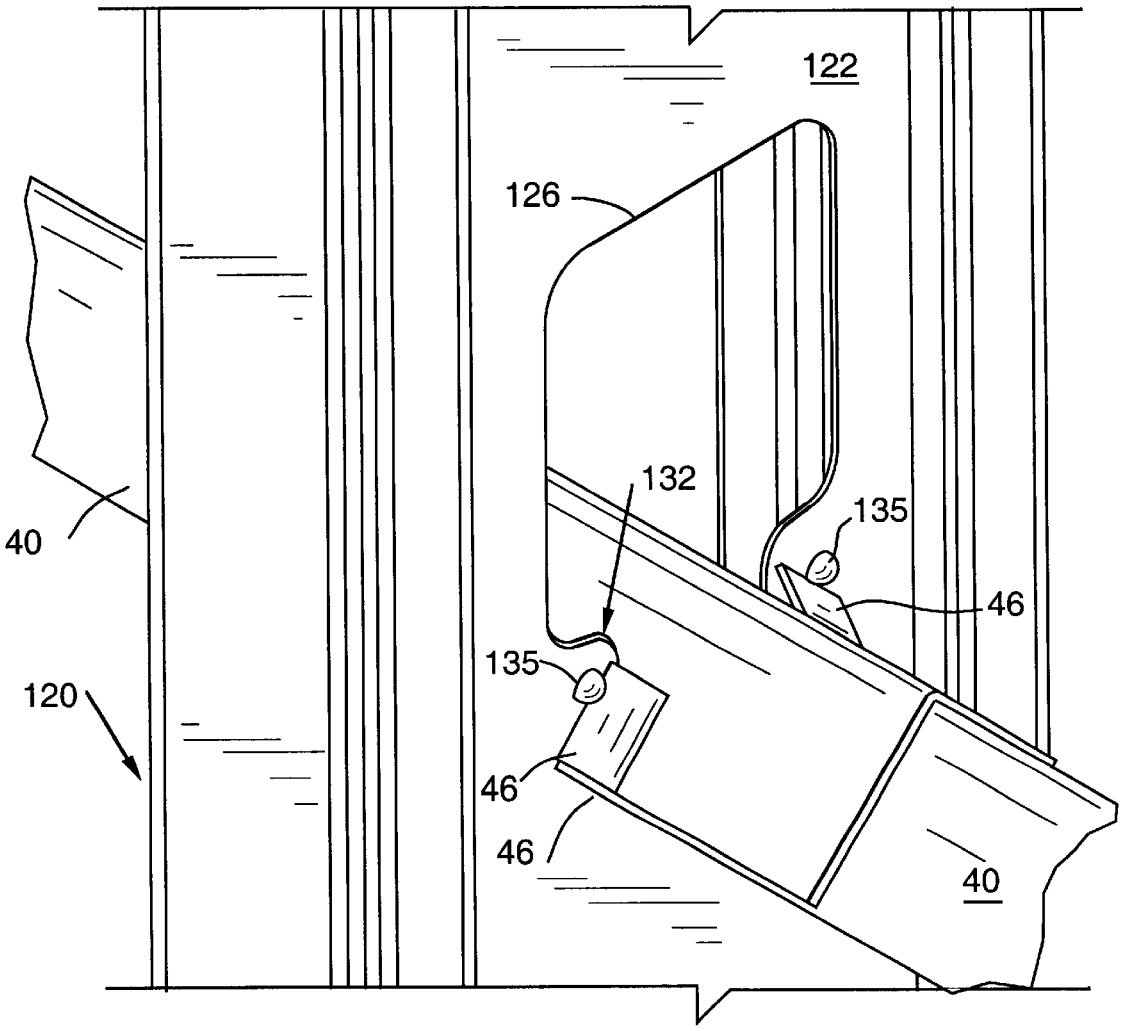
FIG. 13 is a partial perspective view of a pair of overlapping spacer members and the drywall stud depicted in FIG. 11.

Another embodiment of the present invention is depicted in FIGS. 11 and 12. As can be seen in FIG. 11, this embodiment includes at least one stud 120 that is essentially identical in construction when compared to studs 20 above, except for the spacer retainers 135. In particular, this stud 120 has a web 122, two L-shaped legs 124, at least one opening 126 through the web 122 and at least one and preferably two spacer retainers 134 in the form of dimples 135 provided in the shape of a quarter sphere. In this embodiment, the dimples 135 are sized and located such that when the spacer bar member 40 is installed as shown in FIG. 11, the ends of the flaps 46 of the spacer bar 40 engage or essentially "bite" into the dimples 135 thereby retaining the web 122 in the notch 42. In this embodiment, the notch 42 has a width which corresponds to and preferably is slightly less than the thickness of the metal forming the web 122. In addition, the dimples 135 protrude a distance from the web 122 (distance "E" in FIG. 12), so that the corresponding flap 46 retainingly engages the dimple 135 to retain the spacer bar 40 in retaining engagement with the web 122 of the stud 120. Those of ordinary skill in the art will appreciate that, if desired, only one notch 42 which corresponds to a particular stud 120 may be provided and therefore the stud 120 may be provided with a single dimple 135 oriented for retaining engagement with the flap portion 46 of the notch 42 when the spacer bar 40 is seated within the lower portion 132 of the opening 126. If desired, a pair of spacer bars 40 may be overlapped as shown in FIG. 13. In that embodiment, the dimples 135 are located for retaining engagement with the flaps 46 of the uppermost spacer bar 40.

Figure 14:
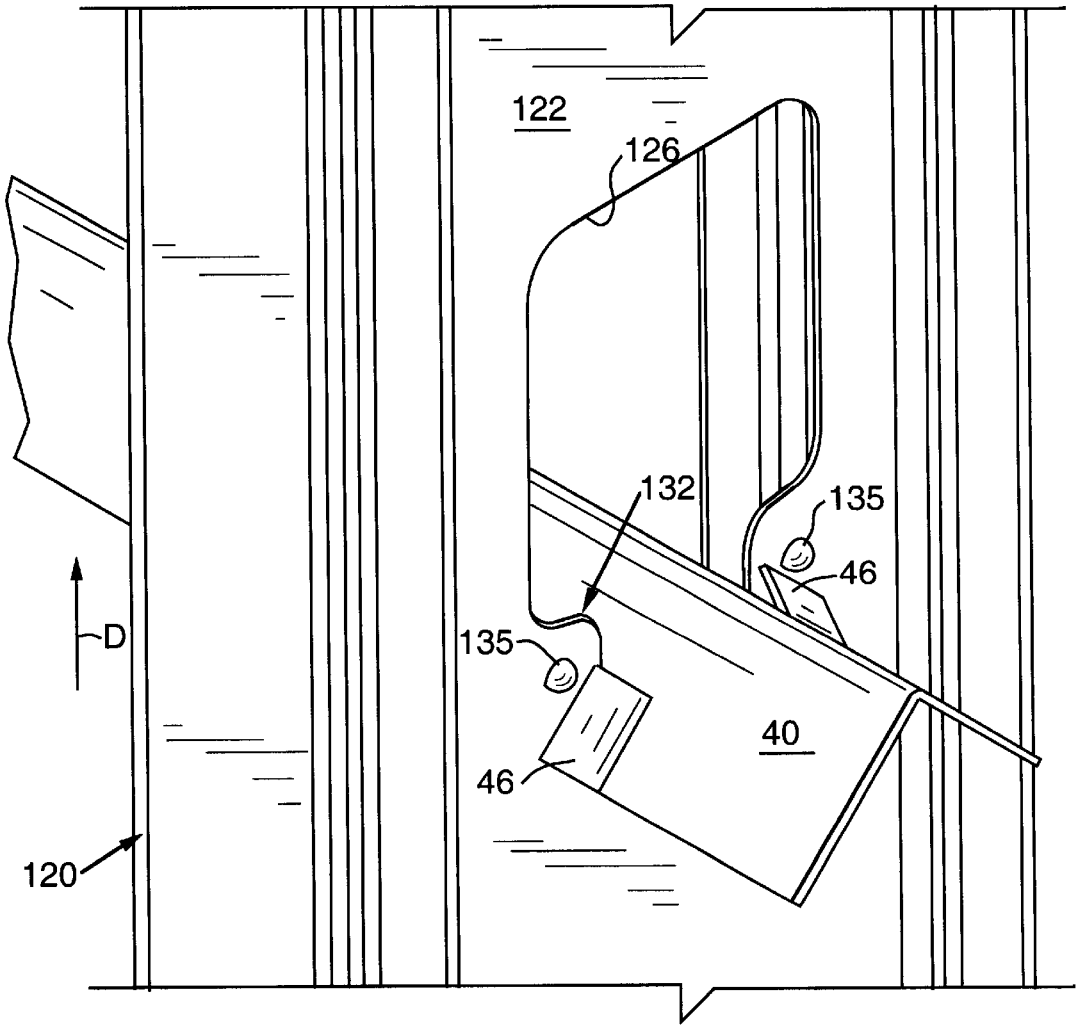
FIG. 14 is a partial perspective view of a spacer member and another drywall stud of the present invention.

In the embodiment depicted in FIG. 14, the dimples 135 are oriented such that when the spacer bar 40 is installed as shown (i.e., in seated engagement within the lower portion 132 of the opening 126) the flaps 46 are not in engagement with the dimples 135, but instead engage portions of the web 122 beneath the dimples 135. In this embodiment, the spacer bar 40 is moved downwardly into the lower portion 132 of the opening, by tapping the spacer bar 40 into position. The width of the notch 42 must be sufficient to permit the flaps 46 to be biased over the dimples 135 when the bar 40 is being installed. Once installed in the position as shown in FIG. 14, the dimples 135 would retard the inadvertent upward movement (direction represented by arrow "D") to prevent the removal of the spacer bar 40 from the stud 20.

Figure 15:
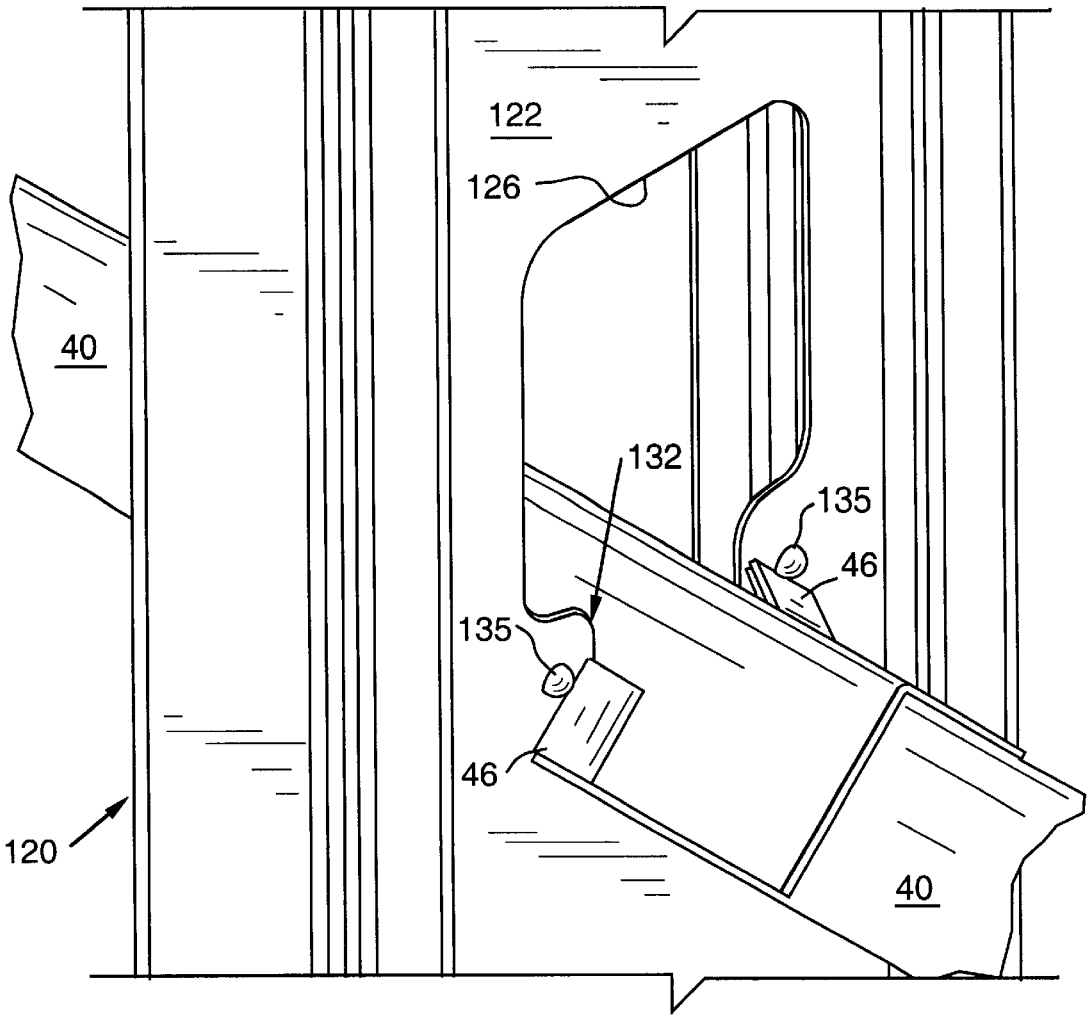
FIG. 15 is a partial perspective view of a pair of overlapping spacer members and the drywall stud of FIG. 14.

FIG. 15 depicts the use of two overlapped spacer bars 40. In that embodiment, the dimples 135 are located relative to the flaps 46 of the uppermost spacer bar 40 such that the flaps 46 do not engage the dimples 135, but the dimples 35 would prevent easy detachment of the spacer bars 40 from the web 122 of the stud 120.

FIGS. 16–23 illustrate yet another embodiment of the present invention wherein structural studs 220 and spacer bars 140 are employed. In this embodiment, each planar side portion of the V-shaped elongated member 141 is provided with a plurality of notches 142 which open to the longitudinal or laterally outer edge 144 of the respective side portion. The notches 142 may be formed to a depth from the edge of about three-eighths of an inch (about 0.95 cm). Although the notches 142 are shown disposed along the outer edge 144 of each side portion, the notches 142 could be formed elsewhere, although less desirably, such as along the vertex (crease) of the V-shape elongated member 141.

The notches 142 of one side portion are laterally aligned with corresponding notches of the other side portion. The pairs of laterally aligned notches 142, as opposed to a single notch, provide two areas of contact with the web 222 of a stud 220. See FIG. 20. The two areas of contact may enhance the grip of the bridging/spacing member 140 on the webs 222 of the studs 220 and aid in preventing the studs 220 from pivoting or twisting, thus adding greater stability to the wall.

Figure 17:
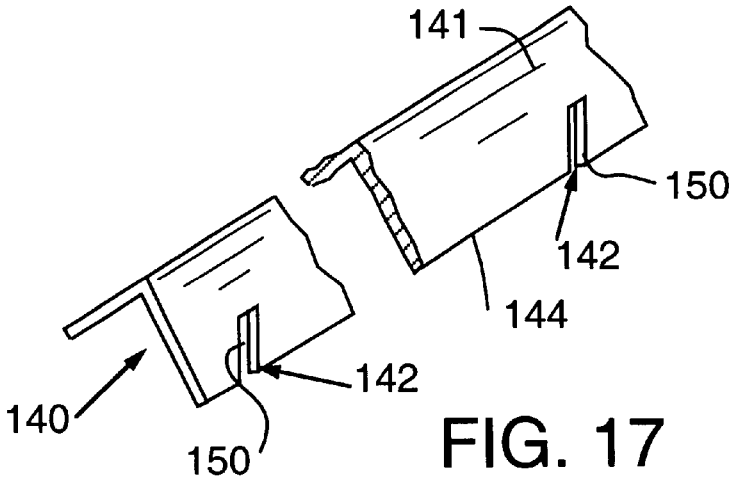
FIG. 17 is a partial perspective view of the spacer member depicted in FIG. 16.
Figure 18:
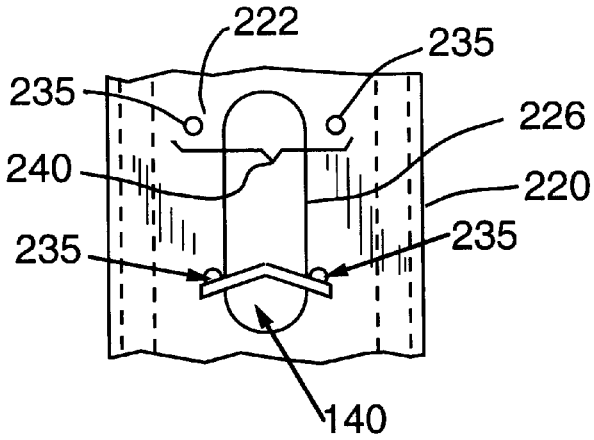
FIG. 18 is a partial view of the spacer member and one stud depicted in FIG. 16.
Figure 20:
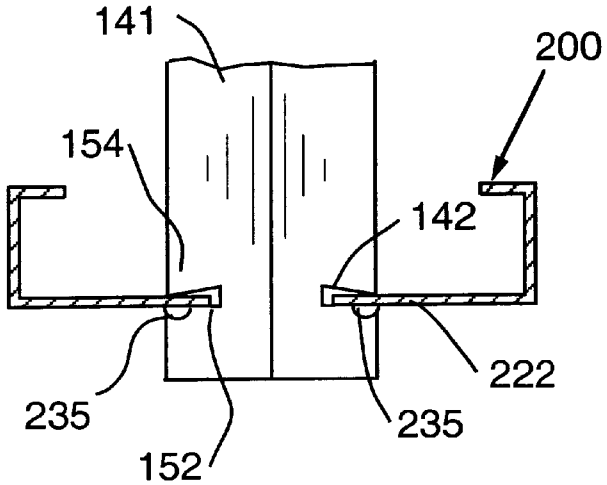
FIG. 20 is a partial cross sectional view of the stud and spacer member of FIG. 18.
Figure 19:
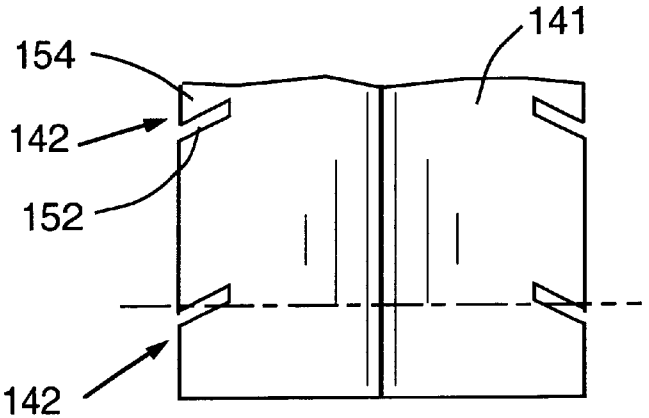
FIG. 19 is a partial top view of the spacer member of FIG. 17.

Referring now to FIGS. 17, 19 and 20, each notch 142 may be formed by a slot 150 inclined relative to the longitudinal axis of the stud bridging/spacing member 140, wherein the angle and the width of the slot 150 cooperate to bind the webs 222 of the studs 220 in the notches 142. The slot 150 may have a width of about 0.065 inch (about 0.16 cm) to about 0.080 inch (about 0.20 cm), and may be angled about five and a half degrees to about eight degrees relative to a perpendicular to the longitudinal axis of the bridging/spacing member 140. More preferably, the slot 150 is angled about seven degrees and has a width of about 0.080 inch (about 0.20 cm). The slot 150 generally has parallel sides that are straight. However, other configurations are contemplated. For example, the slot 150 may have curved parallel sides.

The stud bridging/spacing member 140 may be made of eighteen to fourteen gauge metal. In one embodiment for example, the stud bridging/spacing member is made from 16 gauge 0.0538 inch (0.165 cm) and another embodiment is fabricated from 20 gauge 0.0329 inch (0.1 cm). The width and angle provide notches 142 which have been found to fit twenty gauge studs 220, to fit eighteen gauge studs 220 with a slight bind, and to fit sixteen gauge studs 220 tightly, which may cause the webs 222 of the studs 14 to bend slightly with the notch 142. The notches 142 have also been found to fit fourteen gauge studs 220, with a tight fit. The tighter fit with heavier gauge studs is desired as usually they are used to bear higher loads.

As shown in FIG. 19, the sides of the angled notch 142 form angled shoulders in adjacent portions of the elongated member 141, one of which forms an abutment 152 against which the web 222 of the stud 220 is urged, and the other of which forms a "stud engager" or "stud engagement means" in the form of a barb 154 which can "bite" into the web 222 of the stud 220 and about which the web 222 of the stud 220 may deform as the web 222 is inserted into the notch 142. The angle and the width of the slot 150 cooperate to bind the web 222 of the stud 220 in the slot 150. At least when subjected to loads that would tend to cause the elongated member to become dislodged. The bind forces a portion of the web 222 to bend with the angle of the slot 150. However, generally neither the barb 154 nor the abutment 152 move out of the plane of the planar portion of the elongated member 141.

Figure 21:
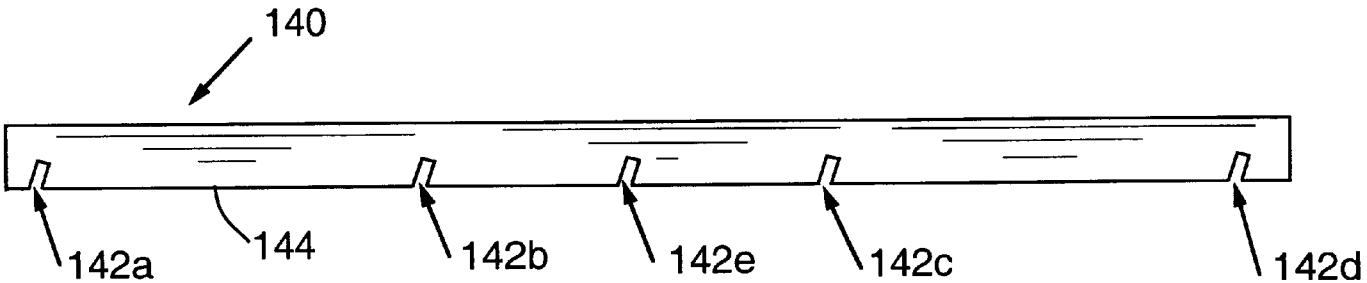
FIG. 21 is a side view of another spacer member of the type depicted in FIG. 17.

As illustrated in FIG. 21, the stud bridging/spacing member 140 includes four notches 142*a*–142*d* spaced at sixteen inch (about 40.6 cm) intervals, and one notch 142*e* equally spaced between the two central notches 142*b* and 142*c*. This particular arrangement of notches 142 creates a stud, bridging/spacing member 140 which can be used in metal stud walls which have a stud spacing of either sixteen or twenty-four inches (about 40.6 cm to 61.0 cm). If the wall is to have a stud spacing of sixteen inches (about 40.6 cm), notches 142*a*–142*d* engage the webs 122 of the studs 120. If the wall is to have a stud spacing of twenty-four inches (about 61.0 cm), notches 142*a*, 142*d*, and 142*e* engage the webs 122 of the studs 120. Since the overall length of the stud bridging/spacing member 140 in this embodiment is about fifty inches (about 127 cm), this leaves about one inch (about 2.5 cm) outside the outermost notches. Those of ordinary skill in the art will appreciate that notches 142*a*–142*d* may be arranged at a variety of intervals depending upon the desired stud spacing. For example, the notches 142*a*–142*d* may be so located to support studs spaced at twelve inch (about 30.5 cm) intervals.

Figure 16:
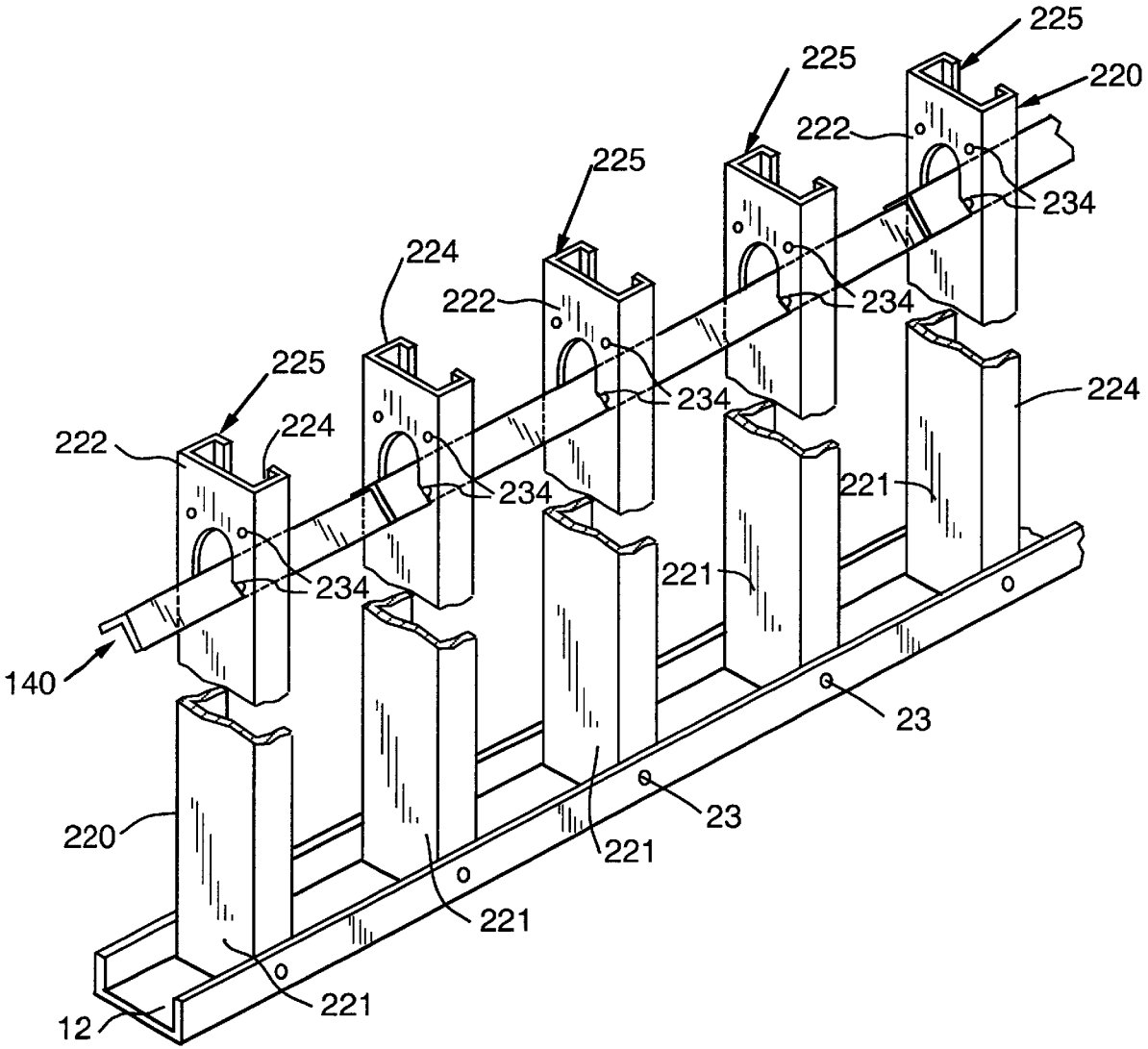
FIG. 16 is a perspective view of another metal stud wall employing another spacer member and other structural studs of one embodiment of the present invention.

As can be seen in FIG. 16, in this embodiment, the spacer member 140 is used in connection with structural studs 220 in the manner described above with respect to drywall studs. However, the structural studs 220 have an oval shaped opening 226 in their webs 222. More particularly, a stud 220 has a web 222, two L-shaped legs 224, at least one opening 226 through the web 222 and at least one and preferably two spacer retainers 234. The opening 226 may have a lower portion 227 and an upper portion 228 and two lateral side portions 229. As can be further seen in FIG. 22, the spacer member 40 is inserted through the opening 226 such that it is received in the bottom portion of the opening 226. The spacer retainers 234 comprise hemispherically shaped dimples 235 formed adjacent the lower end 227 of the opening 226. In this embodiment, the dimples 235 are sized and located such that when the spacer bar member 40 is installed as shown in FIG. 21, the barb 154 of the spacer bar 140 engage or essentially "bite" into the dimples 135 thereby retaining the web 222 in the notch 142. In this embodiment, the notch 142 has a width which corresponds to and preferably is slightly less than the thickness of the metal forming the web 222. In addition, the dimples 235 protrude a distance from the web 222 (distance "F" in FIG. 23), so that the corresponding barb 154 retainingly engages the dimple 235 to retain the spacer bar 140 in retaining engagement with the web 222 of the stud 220. However other notch configurations and widths could conceivably be used.

Figure 22:
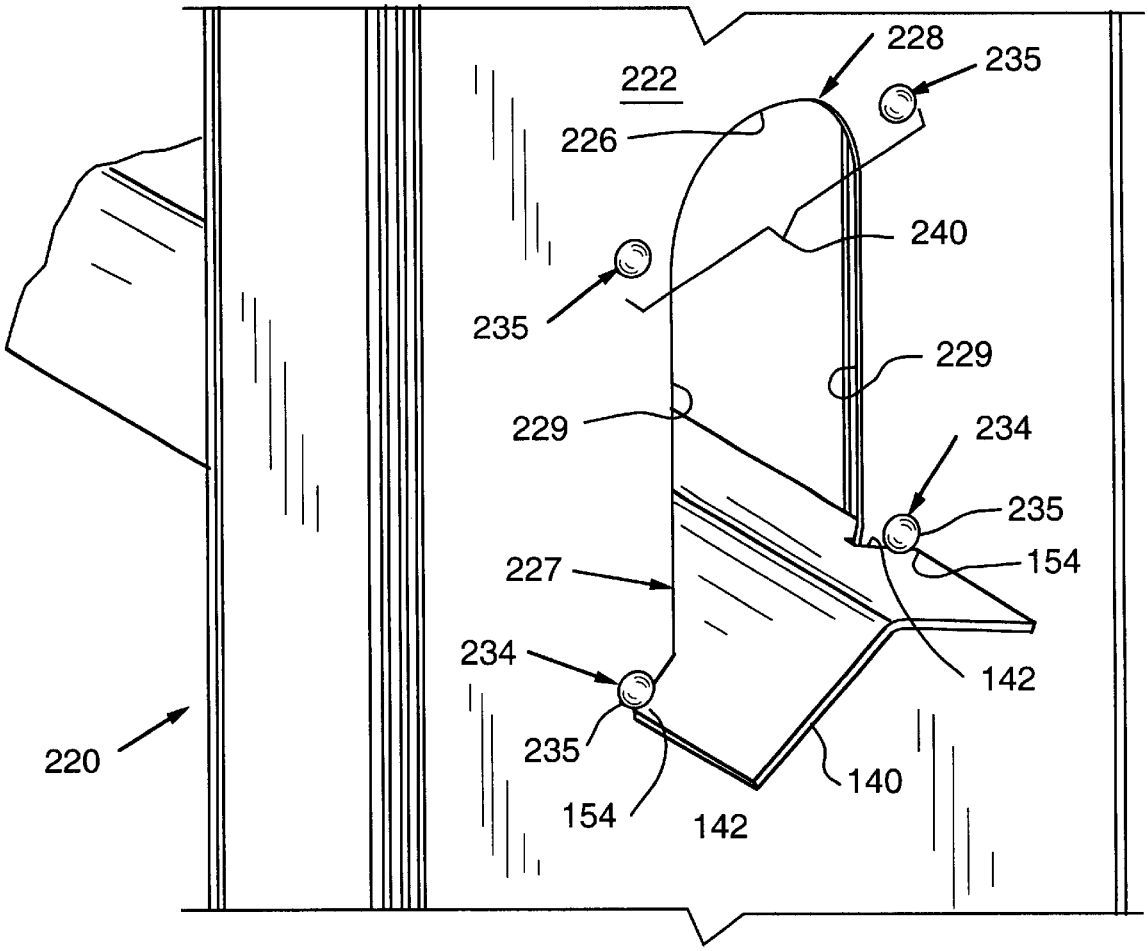
FIG. 22 is a partial perspective view of a spacer member and a structural stud of the present invention.
Figure 23:
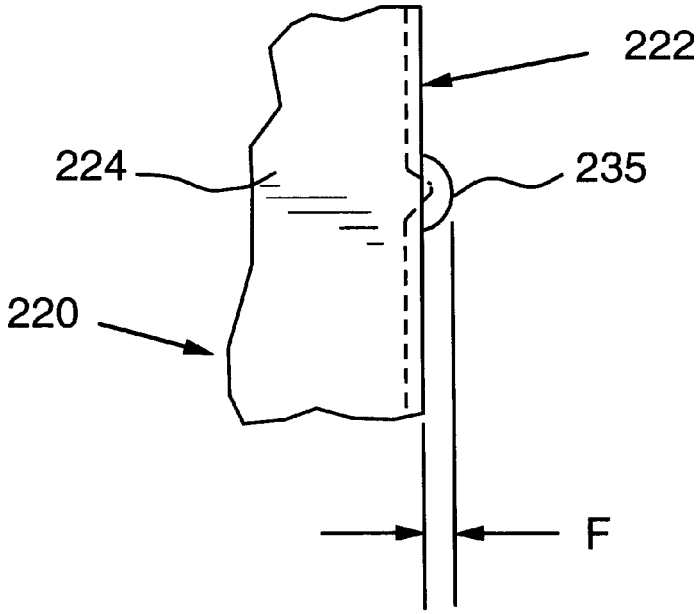
FIG. 23 is a partial view of the stud of FIG. 22.

Those of ordinary skill in the art will appreciate that the studs 220 may be fabricated such that they are symmetrical. When constructed in that manner, either end of a stud may be attached to the bottom track 12. In particular, as shown in FIG. 16, the end 221 of each stud 220 is attached to the bottom track 12. However, in the alternative, the ends 225 may be attached to the bottom track 12. Such stud construction eliminates the need to determine which end of the stud is to be attached to the bottom track and serves to speed up installation. Accordingly, to accommodate retention of the spacer bar 140 regardless of which end of the stud 220 is affixed to the bottom track 12, a second pair 240 of spacer retainers 234 or at least a third spacer retainer 234 is provided adjacent to the other end of the opening 226 as shown in FIGS. 16 and 22. The spacer retainers 234 in that embodiment may be identical to the dimples 235 described above. This feature eliminates the need for the installer to always ensure that the same ends of the studs 20 are always affixed to, for example, the bottom track 12.

Figure 24:
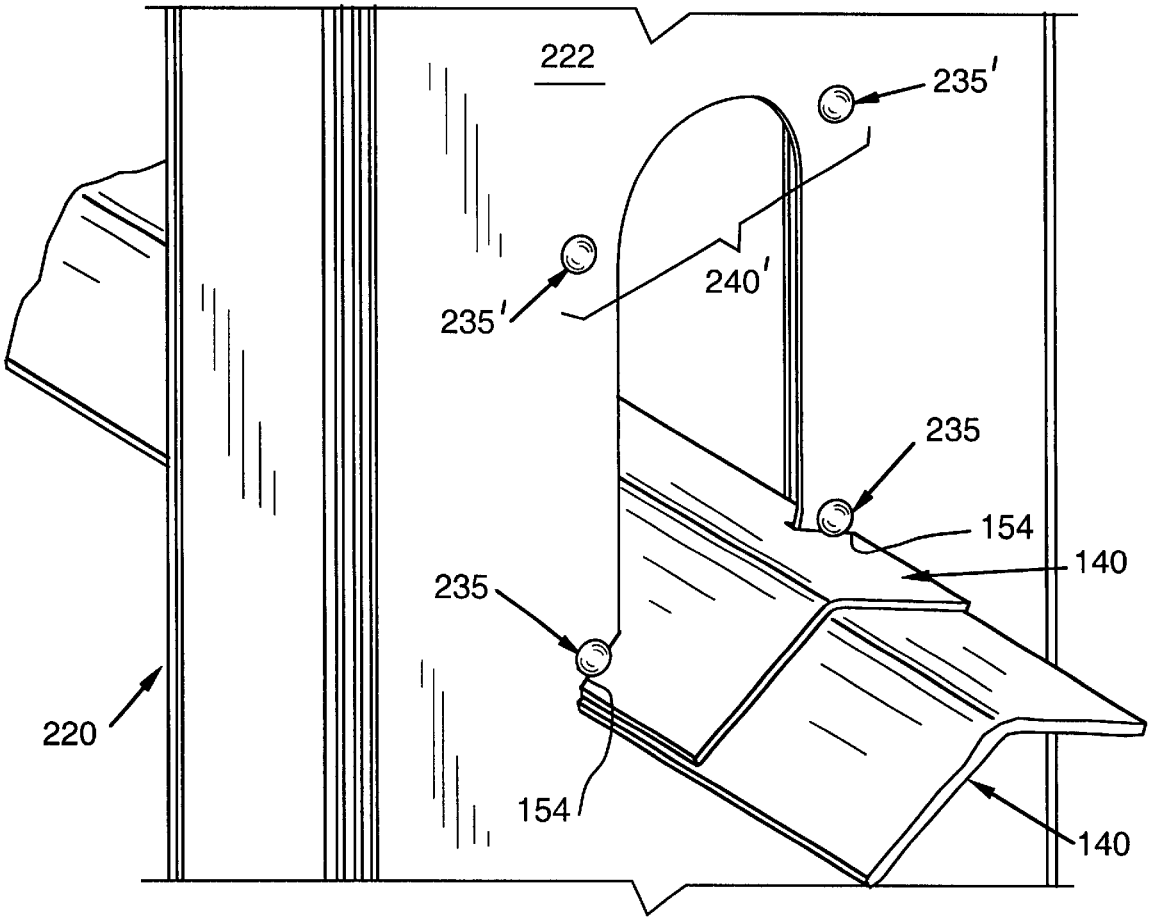
FIG. 24 is a partial perspective view of a pair of overlapping spacer members and the structural stud depicted in FIG. 22.

FIG. 24 depicts the use of two overlapped spacer bars 140. In that embodiment, the dimples 235 are located relative to the barbs 154 of the uppermost spacer bar 140 such that the barbs 154 engage the dimples 235 to prevent the torsional rotation of the studs 20 when the spacer bars have been installed. In addition, the dimples prevent one end of the spacer bar from becoming disengaged while the installer engages the other end of the spacer bar with a corresponding stud or studs.

Figure 25:
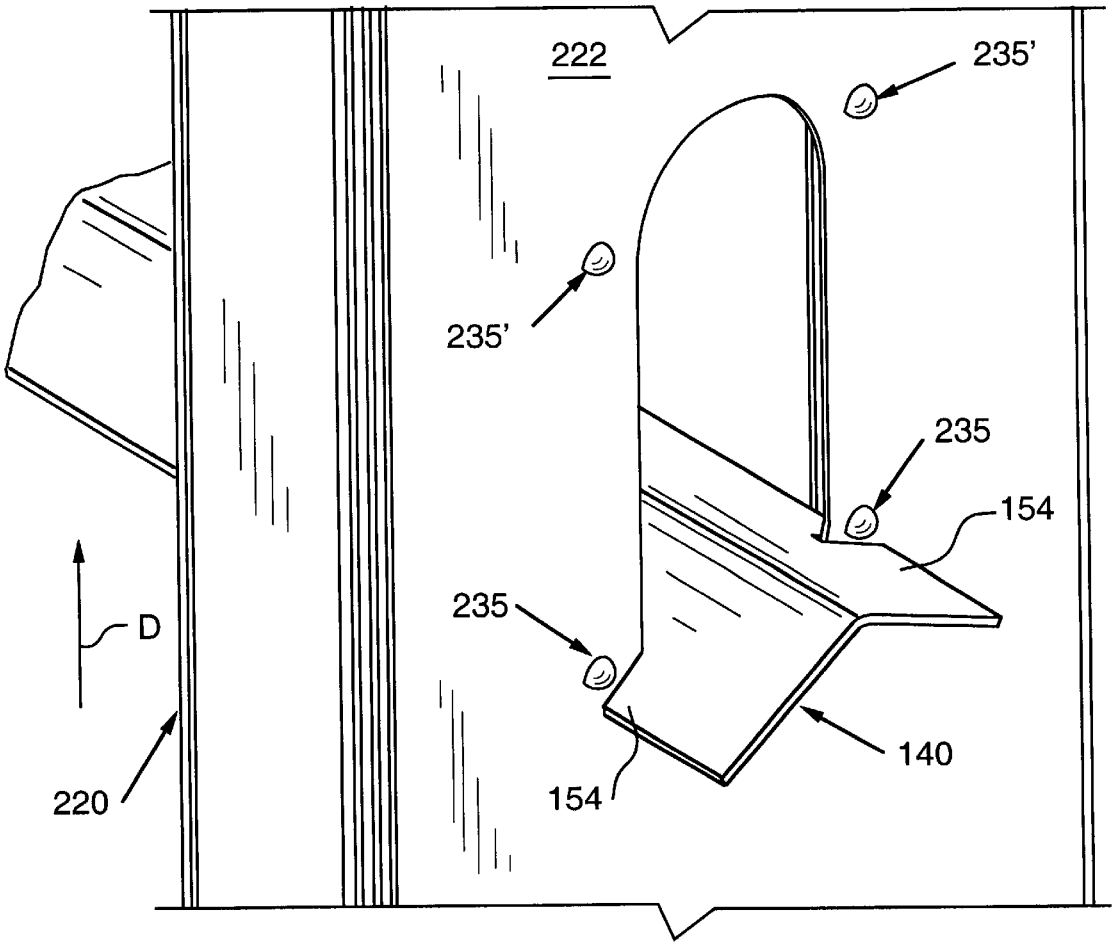
FIG. 25 is a partial perspective view of a spacer member and another structural stud of the present invention.

In the embodiment depicted in FIG. 25, the dimples 235 are oriented such that when the spacer bar 140 is installed as shown (i.e., in seated engagement within the lower portion of the opening 226) the barbs 154 are not in engagement with the dimples 235, but instead engage portions of the web 222 beneath the dimples 235. In this embodiment, the spacer bar 140 is moved downwardly into the lower portion of the opening 226, by tapping the spacer bar 140 into position. The width of the notch 142 must be sufficient to permit the bar to be biased over the dimples 235 when the bar 140 is being installed. Once installed in the position as shown in FIG. 25, the dimples 235 would retard the inadvertent upward movement (direction represented by arrow "D") to prevent the removal of the spacer bar 140 from the stud 220. As can also be seen in FIGS. 24 and 25, a second pair 240' of spacer retainers in the form of dimples 235' may be provided adjacent the other end of the opening 226. Those of ordinary skill in the art will readily appreciate that the pair of spacer retainers 240' eliminate the need for the studs to be installed with a certain one of their respective ends always attached to, for-example, the upper or lower header.

Figure 26:
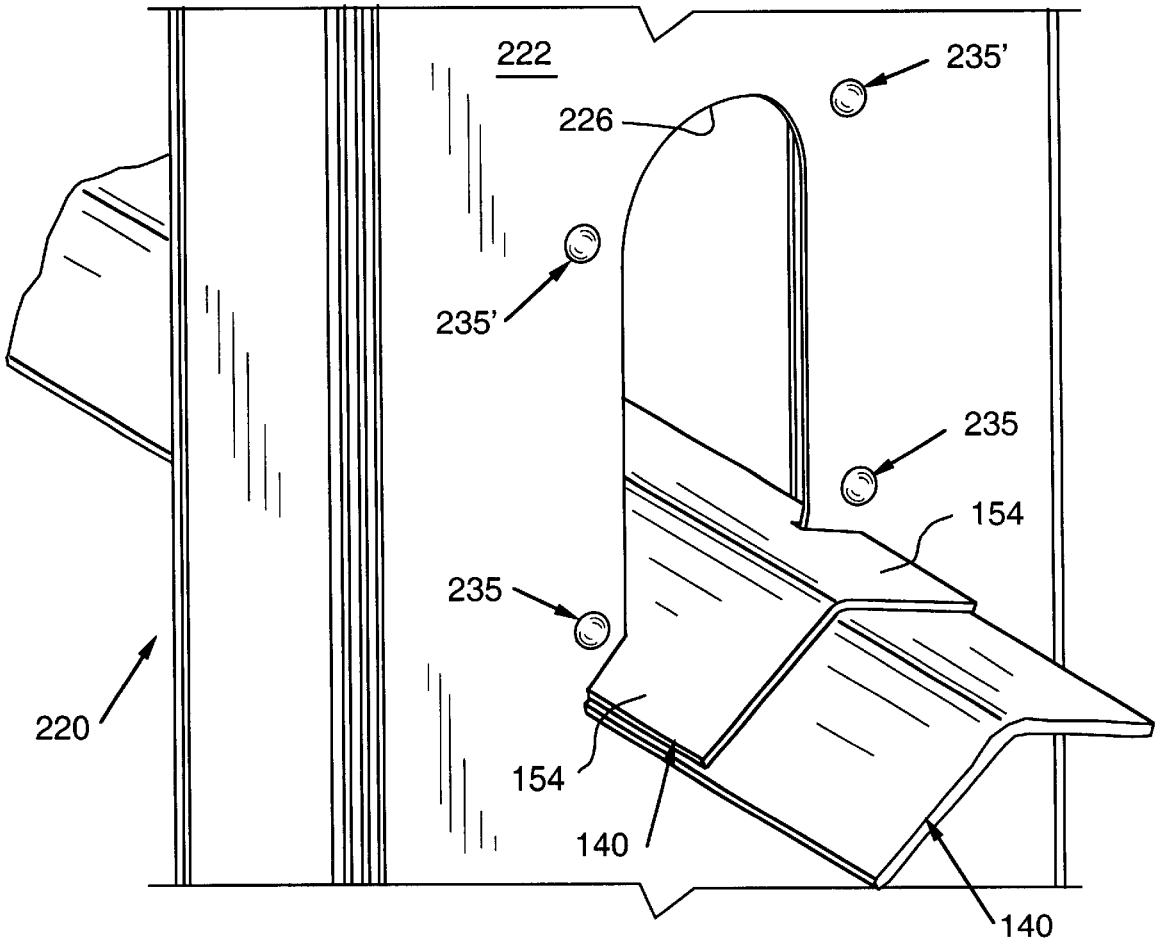
FIG. 26 is a partial perspective view of a pair of overlapping spacer members and the structural stud depicted in FIG. 25.

FIG. 26 depicts the use of two overlapped spacer bars 140. In that embodiment, the dimples 235 are located relative to the barbs 154 of the uppermost spacer bar 140 such that the barbs 154 do not engage the dimples 235, but the dimples 235 would prevent easy detachment of the spacer bars 140 from the web 222 of the stud 220.

Figure 28:
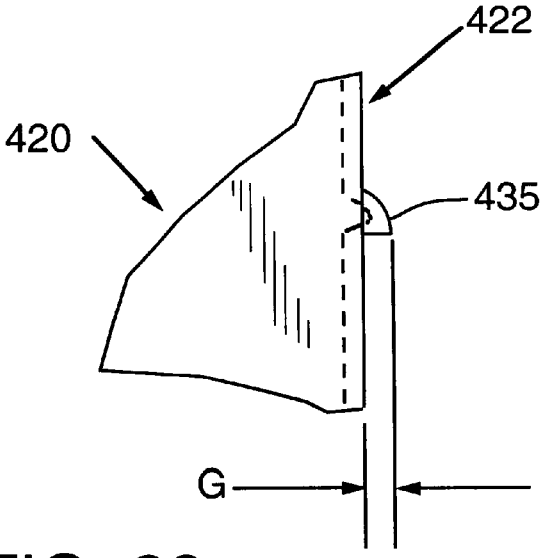
FIG. 28 is a partial view of the stud of FIG. 27.
Figure 27:
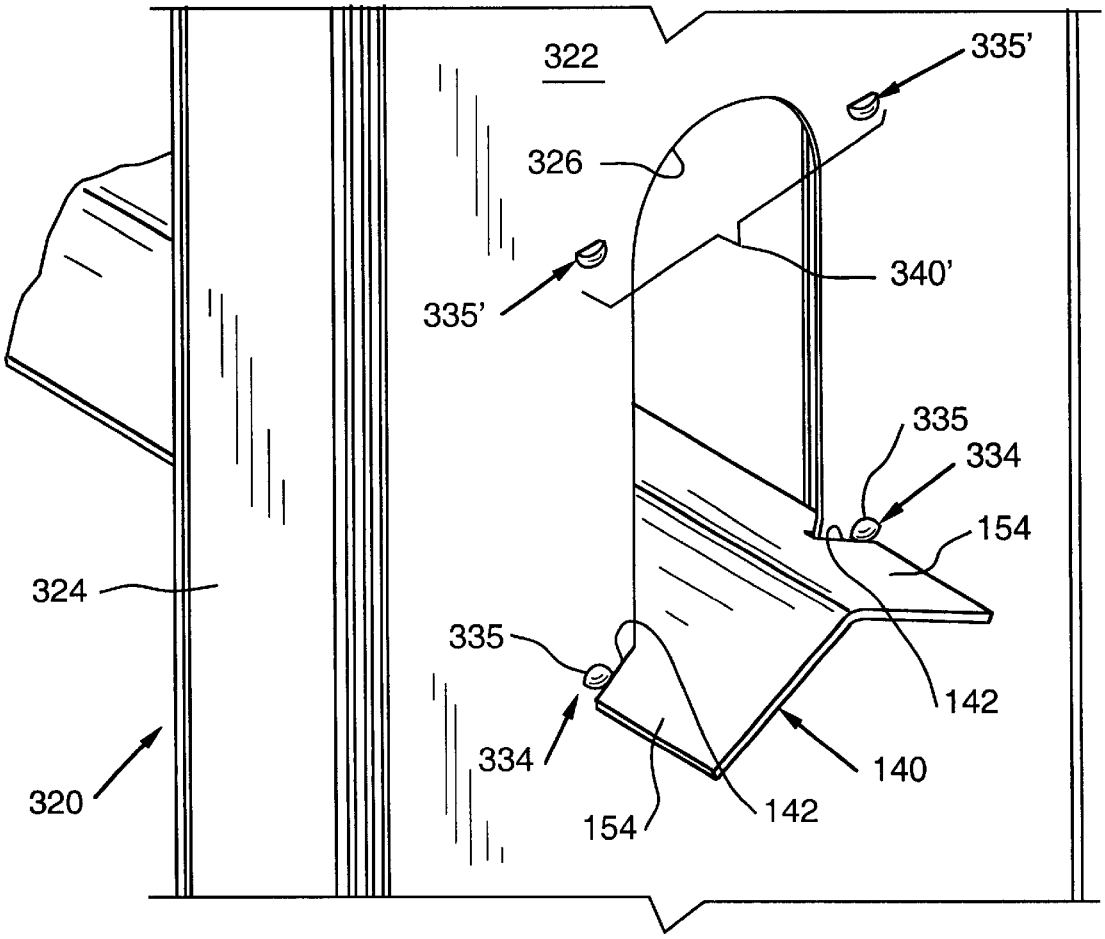
FIG. 27 is a partial perspective view of a spacer member and another structural stud of the present invention.
Figure 29:
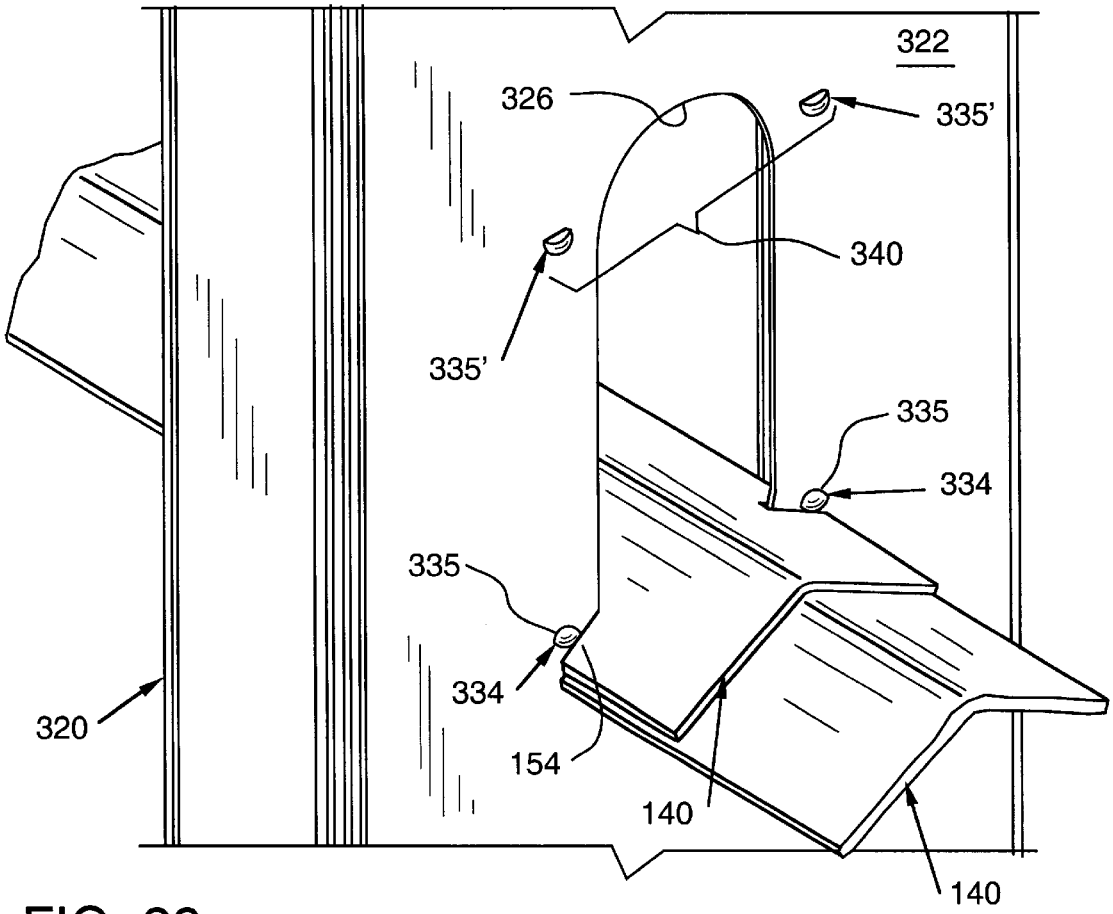
FIG. 29 is a partial perspective view of a pair of overlapping spacer members and the structural stud depicted in FIG. 28.

Another embodiment of the present invention is depicted in FIGS. 27 and 28. As can be seen in FIG. 27, this embodiment includes at least one stud 320 that is essentially identical in construction when compared to studs 220 above, except for the spacer retainers 334. In particular, this stud 320 has a web 322, two L-shaped legs 324, at least one opening 326 through the web 322 and at least one and preferably two spacer retainers 334 in the form of dimples 335 provided in the shape of a quarter sphere. In this embodiment, the dimples 335 are sized and located such that when the spacer bar member 140 is installed as shown in FIG. 27, the barbs 154 of the spacer bar 40 engage or essentially "bite" into the dimples 335 thereby retaining the web 322 in the notch 142. In this embodiment, the notch 142 has a width which corresponds to and preferably is slightly less than the thickness of the metal forming the web 322. In addition, the dimples 335 protrude a distance from the web 122 (distance "G" in FIG. 28), so that the corresponding barb 154 retainingly engages the dimple 335 to retain the spacer bar 140 in retaining engagement with the web 322 of the stud 320. Those of ordinary skill in the art will appreciate that, if desired, only one notch 142 which corresponds to a particular stud 320 may be provided and therefore the stud 320 may be provided with a single dimple 335 oriented for retaining engagement with the barb portion 154 of the notch 142 when the spacer bar 140 is seated within the lower portion of the opening 326. As can also be seen in FIG. 27, a second pair 340' of spacer retainers in the form of dimples 335' may be provided adjacent the other end of the opening 326. If desired, a pair of spacer bars 40 may be overlapped as shown in FIG. 29. In that embodiment, the dimples 335 are located for retaining engagement with the barbs 154 of the uppermost spacer bar 140.

Figure 30:
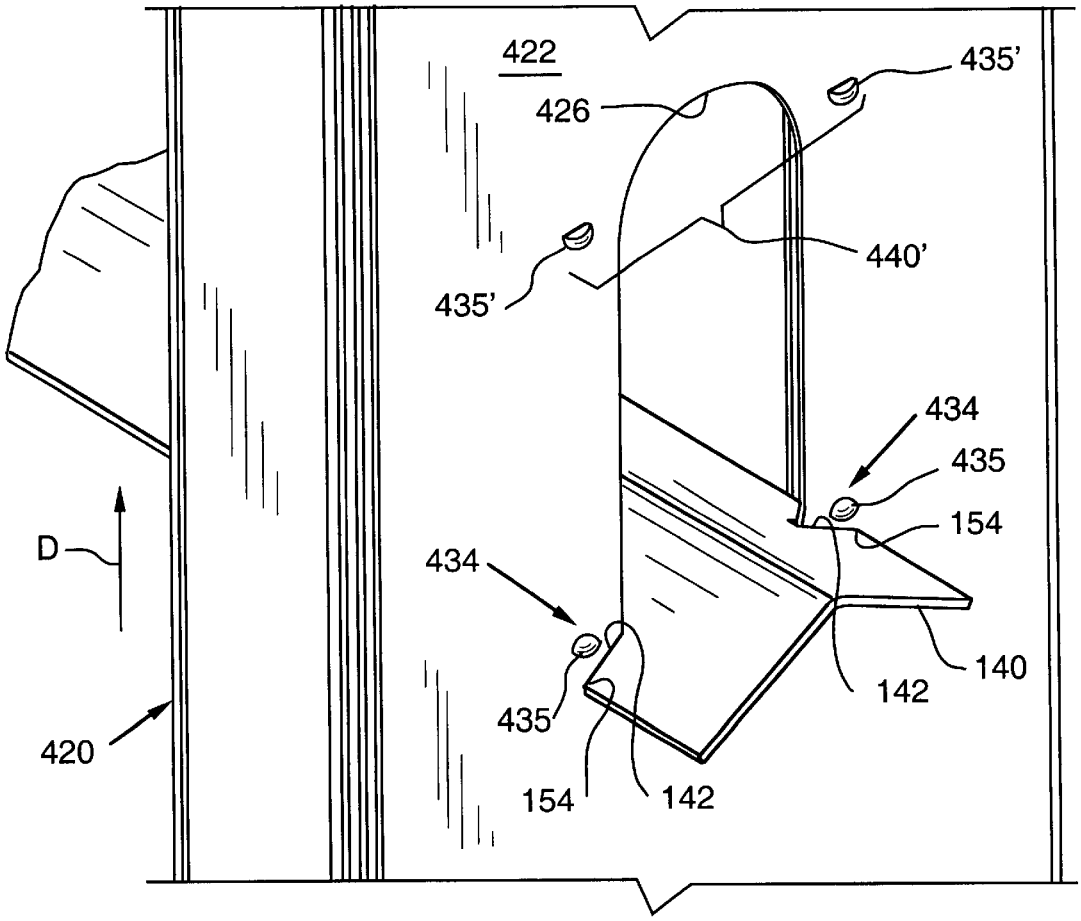
FIG. 30 is a partial perspective view of a spacer member and another structural stud of the present invention.

In the embodiment depicted in FIG. 30, the stud 420 is identical in construction when compared to stud 320. In particular, stud 420 has a web 422 that has an opening 426 therethrough. At least one spacer retainer 434, and preferably two spacer retainers 434 in the form of dimples 435 in the shape of a quarter sphere are oriented such that when the spacer bar 140 is installed as shown (i.e., in seated engagement within the lower portion of the opening 426) the barbs 154 are not in engagement with the dimples 435, but instead engage portions of the web 422 beneath the dimples 435. In this embodiment, the spacer bar 140 is moved downwardly into the lower portion of the opening 426, by tapping the spacer bar 140 into position. The width of the notch 142 must be sufficient to permit the bar to be biased over the dimples 435 when the bar 140 is being installed. Once installed in the position as shown in FIG. 30, the dimples 435 would retard the inadvertent upward movement (direction represented by arrow "D") to prevent the removal of the spacer bar 140 from the stud 420. Also, a second pair 440' of spacer retainers 434' in the form of dimples 435' in the shape of a quarter sphere may be provided adjacent the other end of the opening 426 as shown in FIG. 30. The dimples 435, 435' may be integrally formed in the web 422 or otherwise attached thereto by the various methods and mediums described above. In addition, dimples 435, 435' may protrude the same distance from the web 422 as the dimples 335, 335' protrude from web 322 as described above.

Figure 31:
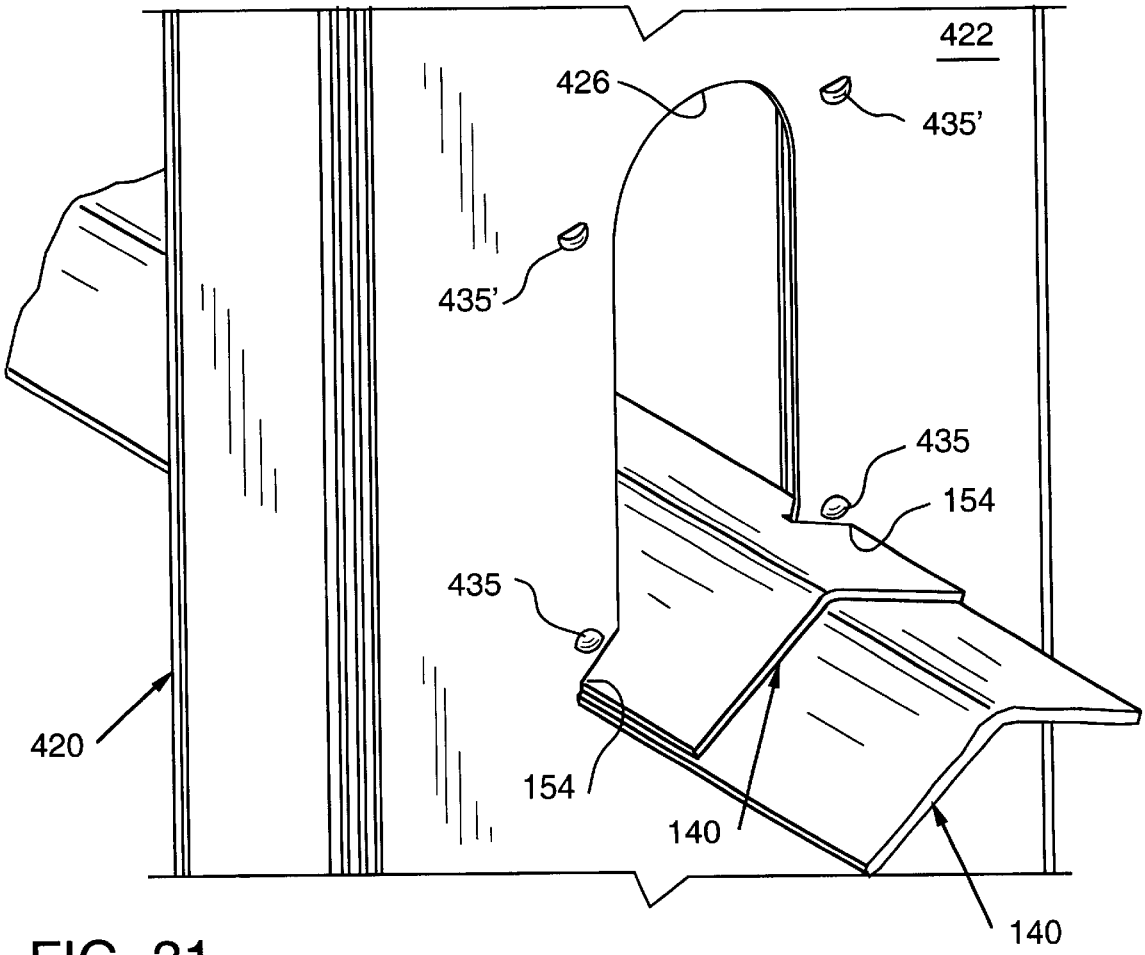
FIG. 31 is a partial perspective view of a pair of overlapping spacer members and the structural stud depicted in FIG. 30.

FIG. 31 depicts the use of two overlapped spacer bars 140. In that embodiment, the dimples 435 are located relative to the barbs 154 of the uppermost spacer bar 140 such that the barbs 154 do not engage the dimples 435, but the dimples 435 would prevent easy detachment of the spacer bars 140 from the web 422 of the stud 420.

Figure 33:
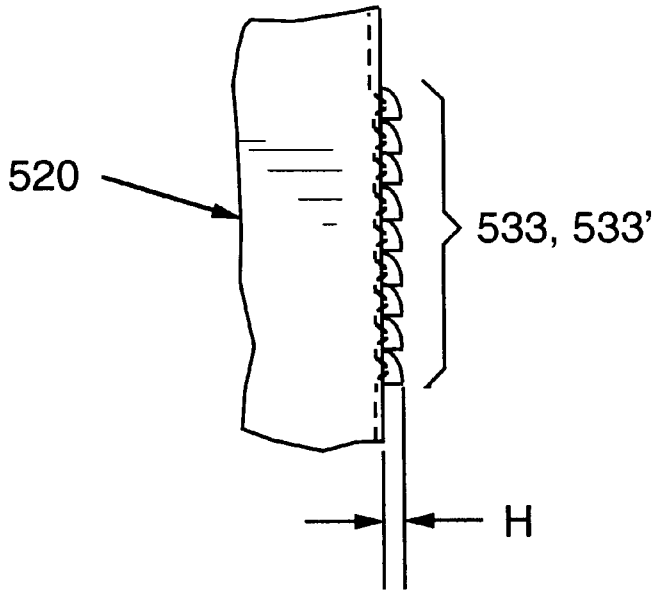
FIG. 33 is a partial view of the stud of FIG. 32.
Figure 32:
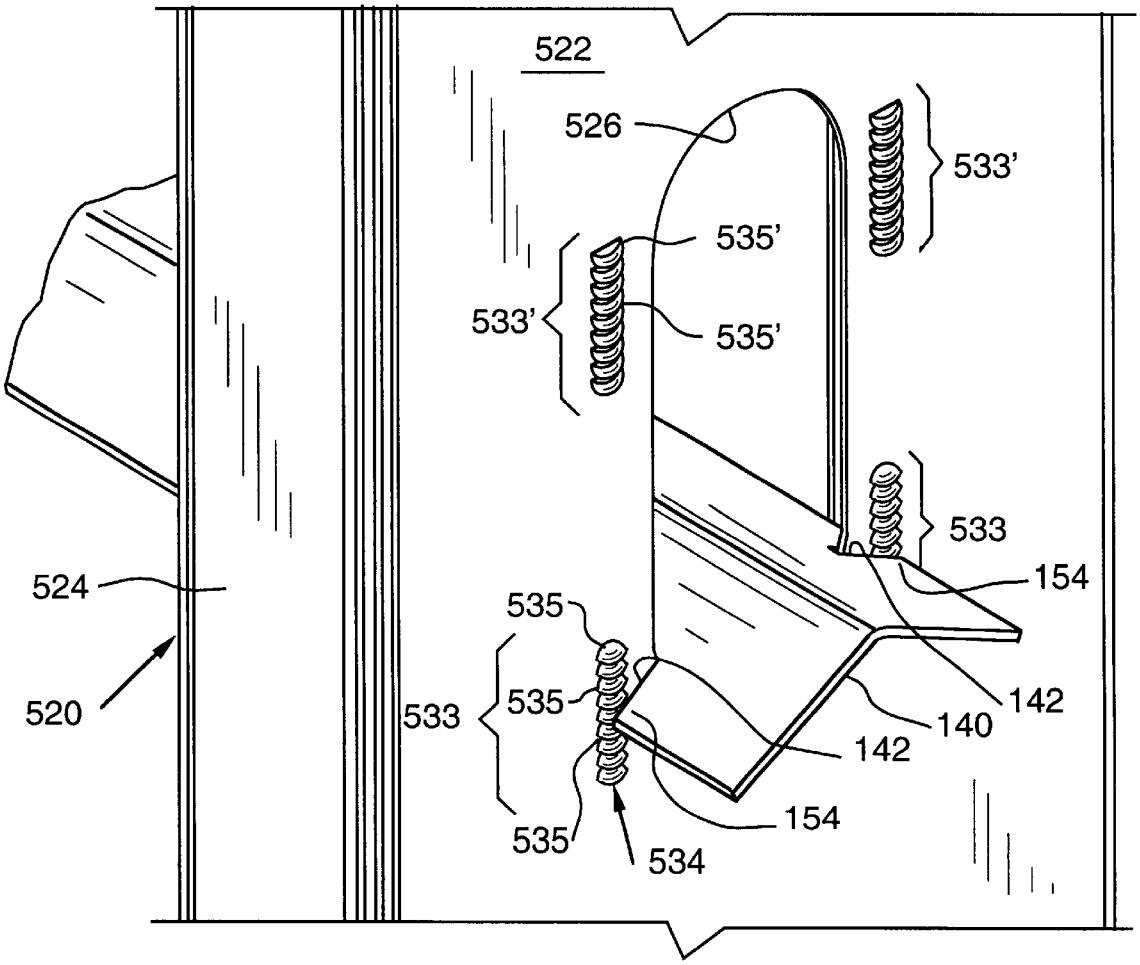
FIG. 32 is a partial perspective view of a spacer member and another structural stud of the present invention.

Another embodiment of the present invention is depicted in FIGS. 32 and 33. As can be seen in FIG. 32, this embodiment includes at least one stud 520 that is essentially identical in construction when compared to studs 420 above, except for the arrangement of spacer retainers 534, 534'. In particular, this stud 520 has a web 522, two L-shaped legs 524, at least one opening 526 through the web 522 and at least one and preferably two series 533 of stacked spacer retainers 534 in the form of dimples 535 provided in the shape of a quarter sphere. In this embodiment, a series of nine dimples 535 are sized and located along the sides of the opening 526 adjacent one end thereof such that when the spacer bar member 140 is installed as shown in FIG. 32, the barbs 154 of the spacer bar 140 engage or essentially "bite" into at least one of the dimples 535 thereby retaining the web 522 in the notch 142. In this embodiment, the notch 142 has a width which corresponds to and preferably is slightly less than the thickness of the metal forming the web 522. In addition, the dimples 535 protrude a distance from the web 522 (distance "H" in FIG. 33), so that the corresponding barb 154 retainingly engages the dimple 535 to retain the spacer bar 140 in retaining engagement with the web 522 of the stud 520. However other notch configurations and widths could conceivably be used. Those of ordinary skill in the art will appreciate that, if desired, only one notch 142 which corresponds to a particular stud 520 may be provided and therefore the stud 520 may be provided with a single series 533 of stacked dimples 535 oriented for retaining engagement with the barb portion 154 of the notch 142 when the spacer bar 140 is seated within the lower portion of the opening 526. As can also be seen in FIG. 32, a second series 533' of stacked spacer retainers 534' in the form of dimples 535' may be provided adjacent the other end of the opening 536 on each side thereof. As used herein, the term "series" refers to at least two stacked spacer retainers. As with the above-described embodiments, the spacer retainers 534, 534' may be integrally formed from the web 522 or otherwise formed from a separate material of the types described above and otherwise attached to the web 522 of the stud 520 by the various methods described above.

Figure 34:
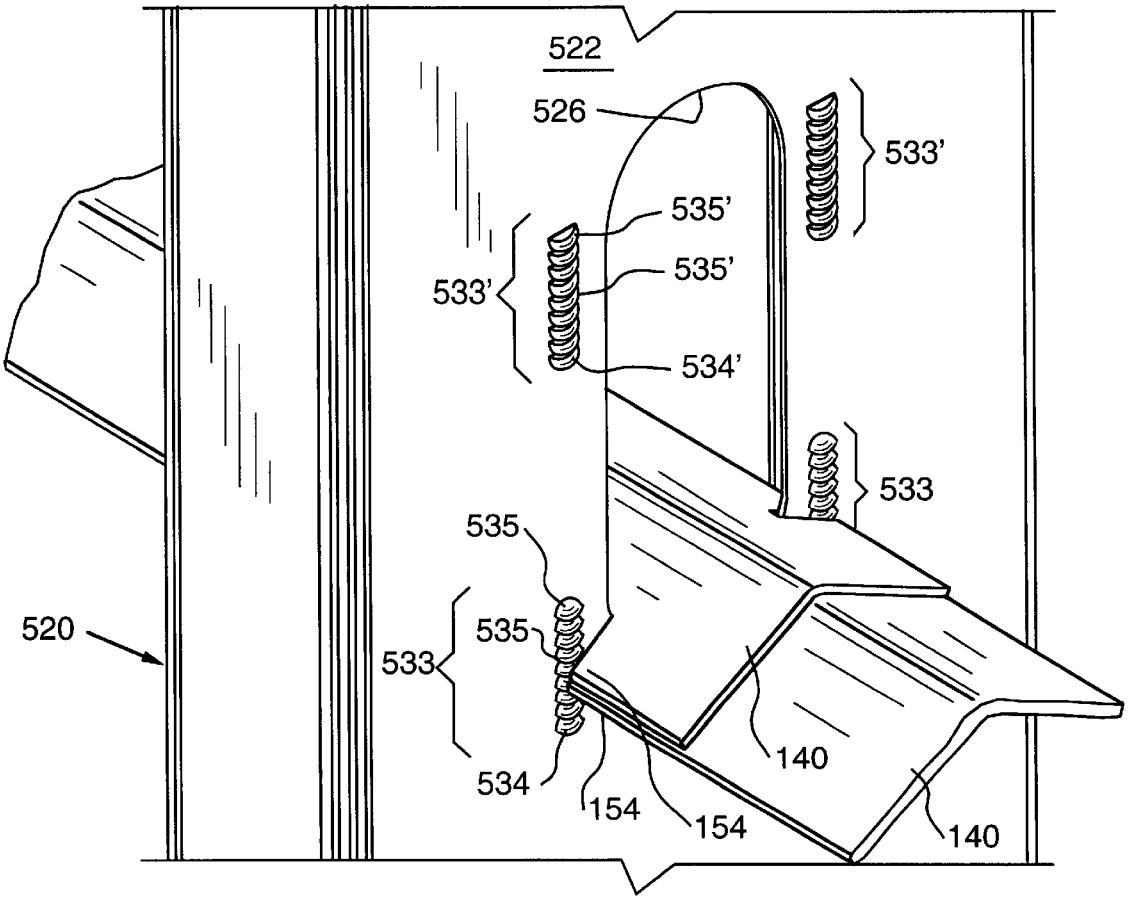
FIG. 34 is a partial perspective view of a pair of overlapping spacer members and the structural stud depicted in FIG. 32.

If desired, a pair of spacer bars 140 may be overlapped as shown in FIG. 34. In that embodiment, the series 533 of stacked dimples 535 may be located for retaining engagement with the barbs 154 of both of the spacer bars 140.

Figure 35:
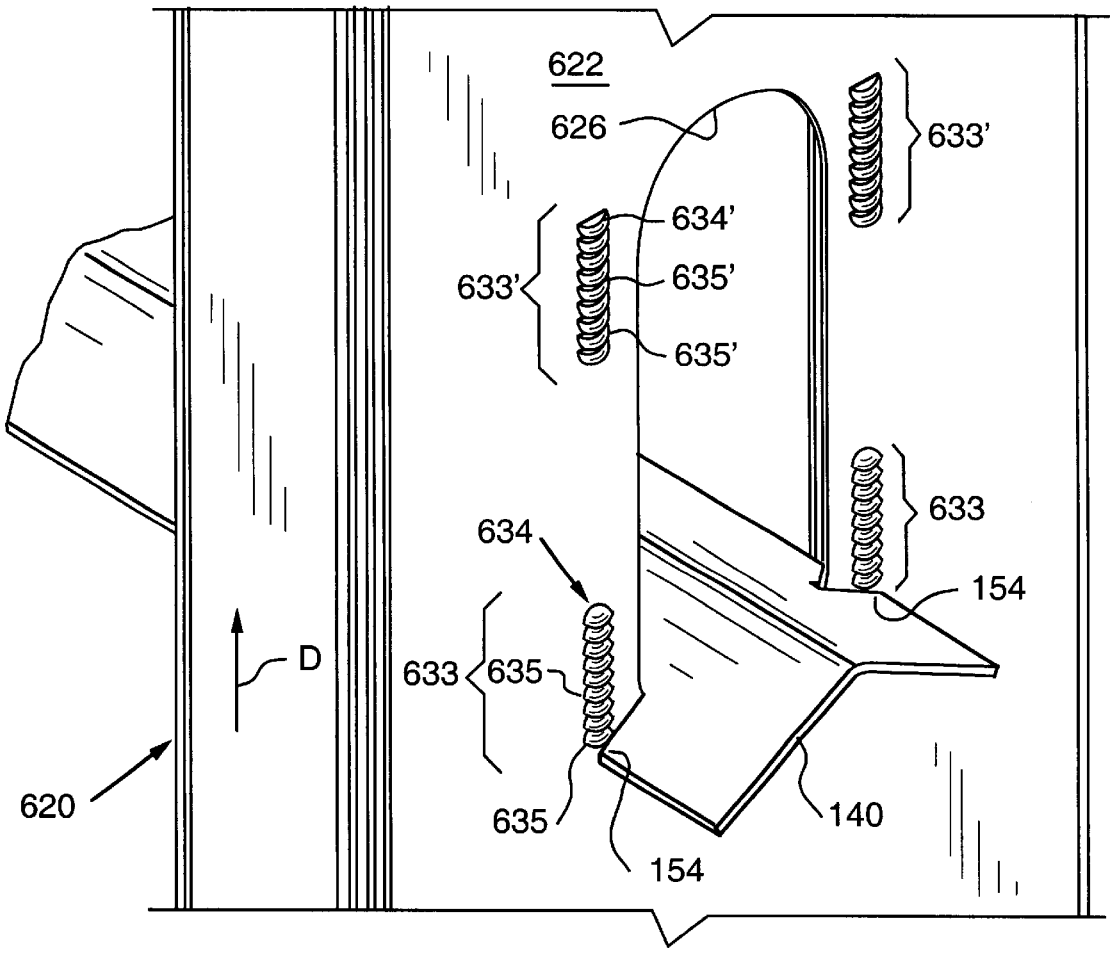
FIG. 35 is a partial perspective view of a spacer member and another structural stud of the present invention.

In the embodiment depicted in FIG. 35, the stud 620 is identical in construction when compared to stud 520. In particular, stud 620 has a web 622 that has an opening 626 therethrough and at least one and preferably two series 633 of stacked spacer retainers 634 in the form of dimples 635 provided in the shape of a quarter sphere. The dimples 635 are oriented such that when the spacer bar 140 is installed as shown (i.e., in seated engagement within the lower portion of the opening 626) the barbs 154 are not in engagement with the dimples 635, but instead engage portions of the web 622 beneath the dimples 635. In this embodiment, the spacer bar 140 is moved downwardly into the lower portion of the opening 626, by tapping the spacer bar 140 into position. The width of the notch 142 must be sufficient to permit the bar to be biased over the dimples 635 when the bar 140 is being installed. Once installed in the position as shown in FIG. 35, the dimples 635 would retard the inadvertent upward movement (direction represented by arrow "D") to prevent the removal of the spacer bar 140 from the stud 620. Also, a second series 633' of stacked spacer retainers 634' in the form of dimples 635' may be provided on each side of the other end of the opening 626 as shown. The dimples 635, 635' may be integrally formed in the web 622 or otherwise attached thereto by the various methods and mediums described above. In addition, dimples 635, 635' may protrude the same distance from the web 622 as the dimples 535, 535' protrude from web 522 as described above.

Figure 36:
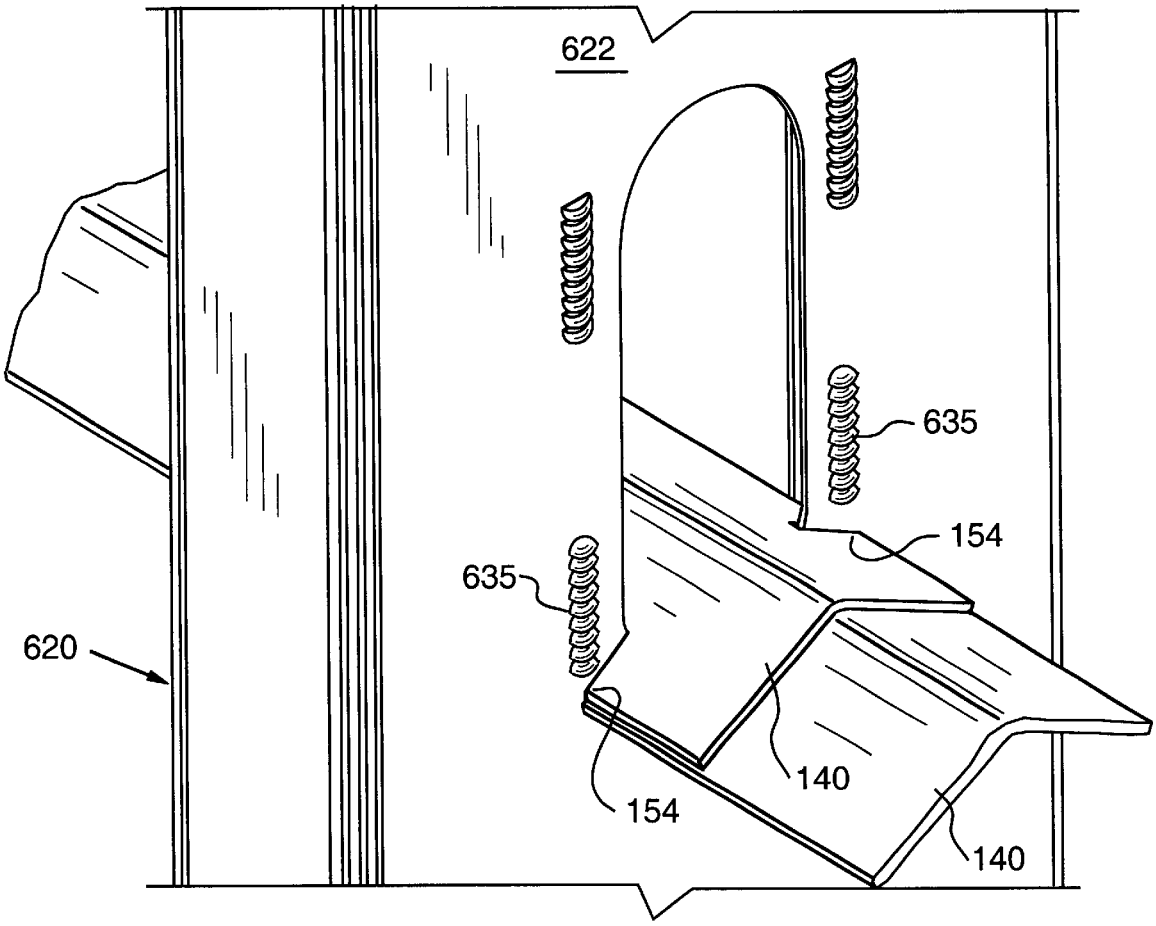
FIG. 36 is a partial perspective view of a pair of overlapping spacer members and the structural stud depicted in FIG. 35.

FIG. 36 depicts the use of two overlapped spacer bars 140. In that embodiment, the dimples 635 are located relative to the barbs 154 of the uppermost spacer bar 140 such that the barbs 154 do not engage the dimples 635, but the dimples 635 would prevent easy detachment of the spacer bars 140 from the web 622 of the stud 620.

Figure 37:
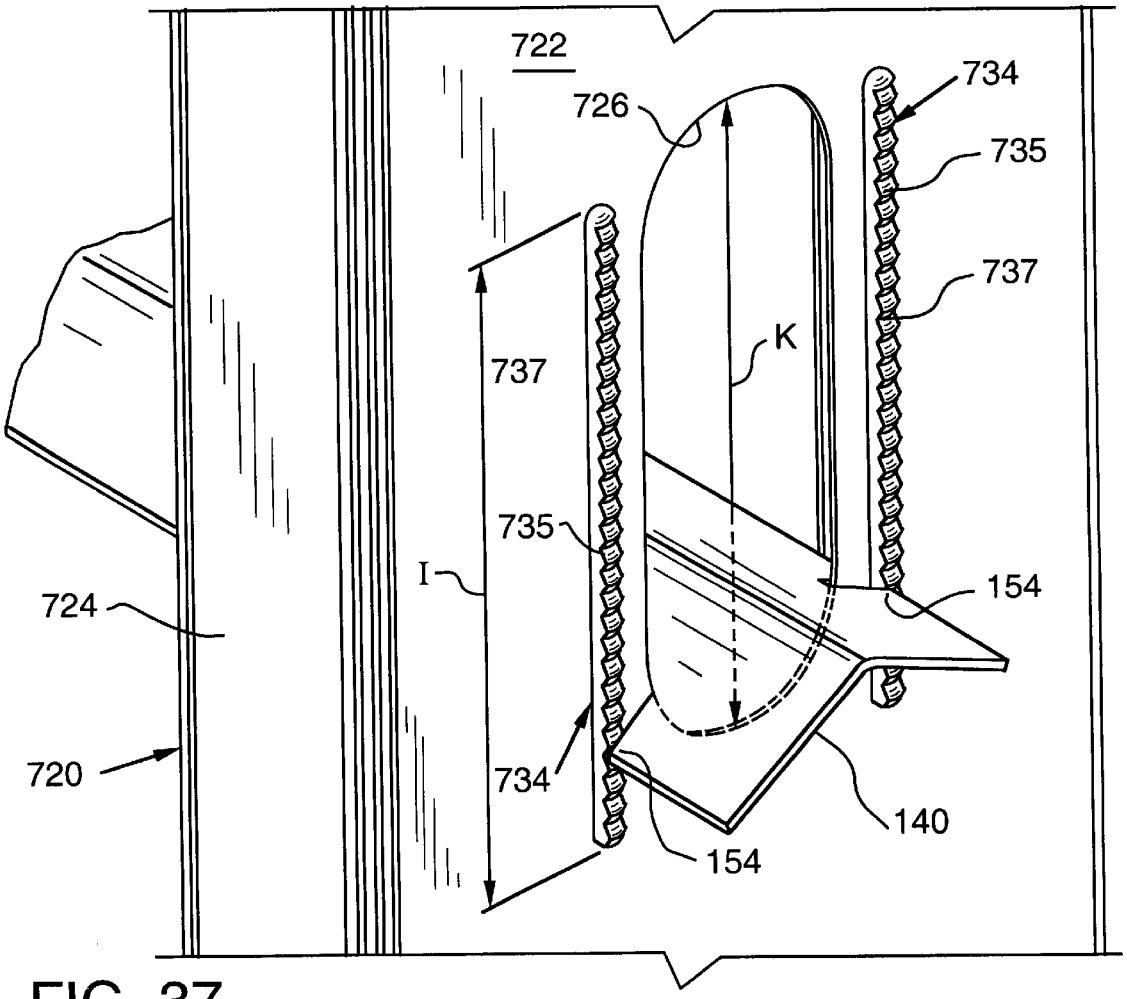
FIG. 37 is a partial perspective view of a spacer member and another structural stud of the present invention.
Figure 38:
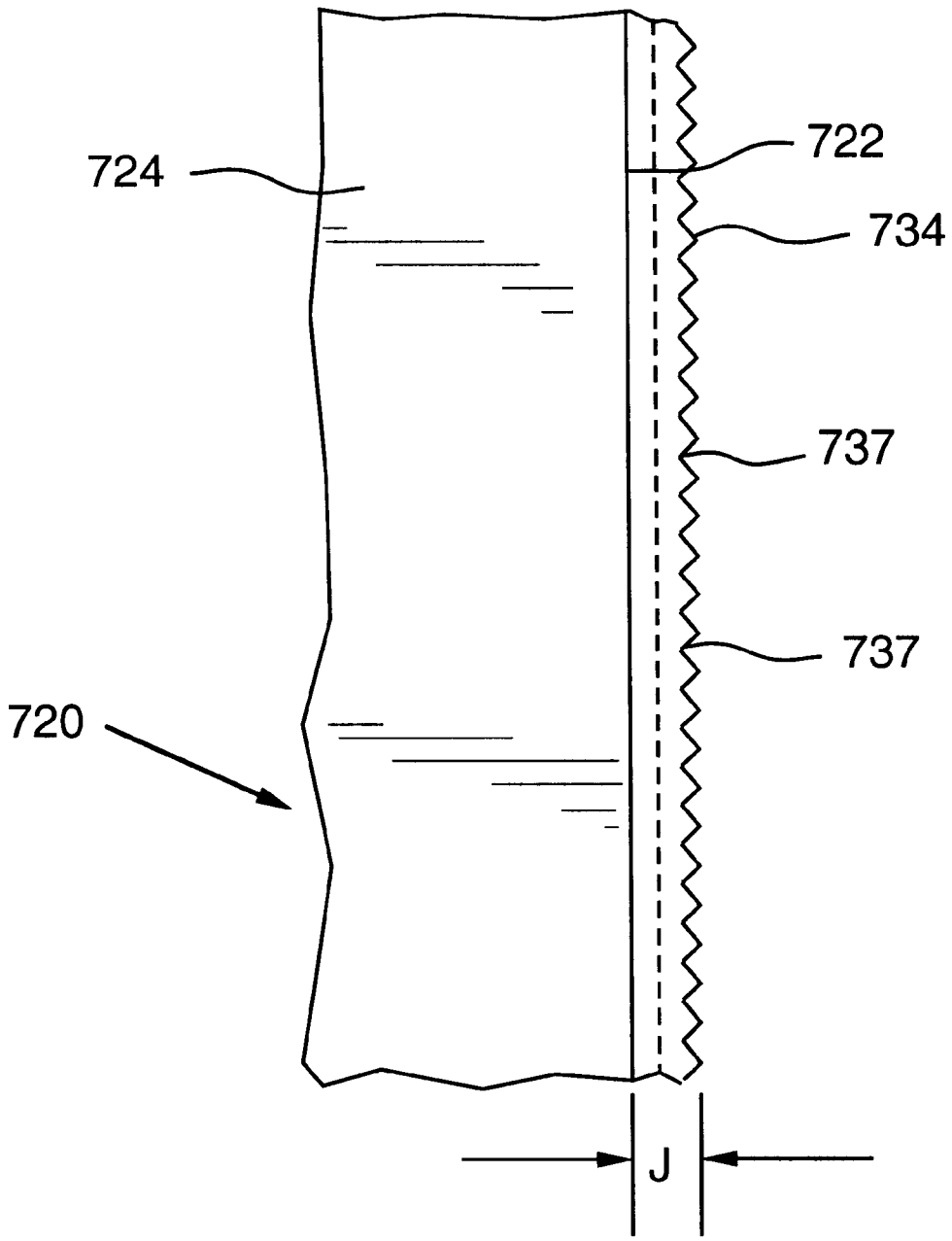
FIG. 38 is a partial view of the stud of FIG. 37.

Another embodiment of the present invention is depicted in FIGS. 37 and 38. As can be seen in FIG. 37, this embodiment includes at least one stud 720 that is essentially identical in construction when compared to studs 620 above, except for the spacer retainers 734. In particular, this stud 720 has a web 722, two L-shaped legs 724, at least one elongated opening 726 through the web 722 that has a length designated as "K". At least one and preferably two elongated continuous spacer retainers 734 are oriented adjacent the sides of the opening 726. In this embodiment, the spacer retainers 734 have the shape of a quarter sphere and have a series of serrations 737. Also in this embodiment, the length "I" of the spacer retainers is greater than the length "K" of the opening 726 such that a portion of the spacer retainers 734 protrude beyond the ends of the opening 726 as shown. For example, for an opening that is 4 inches (10.16 cm) long, the spacer retainers 734 may be 6 inches (15.24 cm) long. However, other lengths and arrangements could be easily employed. Those of ordinary skill in the art will recognize that the spacer retainers 734 need only extend far enough beyond the ends of the opening to engage the spacer bar. The spacer retainers 734 are oriented such that when the spacer bar member 140 is installed as shown in FIG. 37, the barbs 154 of the spacer bar 140 engage or essentially "bite" into at least one of the spacer retainers 734 thereby retaining the web 722 in the notch 142. In this embodiment, the notch 142 has a width which corresponds to and preferably is slightly less than the thickness of the metal forming the web 722. In addition, the spacer retainers 734 protrude a distance from the web 722 (distance "J" in FIG. 38), so that the corresponding barb 154 retainingly engages the spacer retainer 734 to retain the spacer bar 140 in retaining engagement with the web 722 of the stud 720. Those of ordinary skill in the art will appreciate that, if desired, only one notch 142 which corresponds to a particular stud 720 may be provided and therefore the stud 720 may be provided with a single spacer retainer 734 oriented for retaining engagement with the barb portion 154 of the notch 142 when the spacer bar 140 is seated within an end portion of the opening 726. As shown in FIGS. 37 and 38, a plurality of serrations may be provided in the spacer retainers 734. In the alternative, however, the spacer retainers may be formed without such serrations if so desired. As with the above-described embodiments, the spacer retainers 734 may be integrally formed from the web 722 or otherwise formed from a separate material of the types described above and otherwise attached to the web 722 of the stud 720 by the various methods described above.

Figure 39:
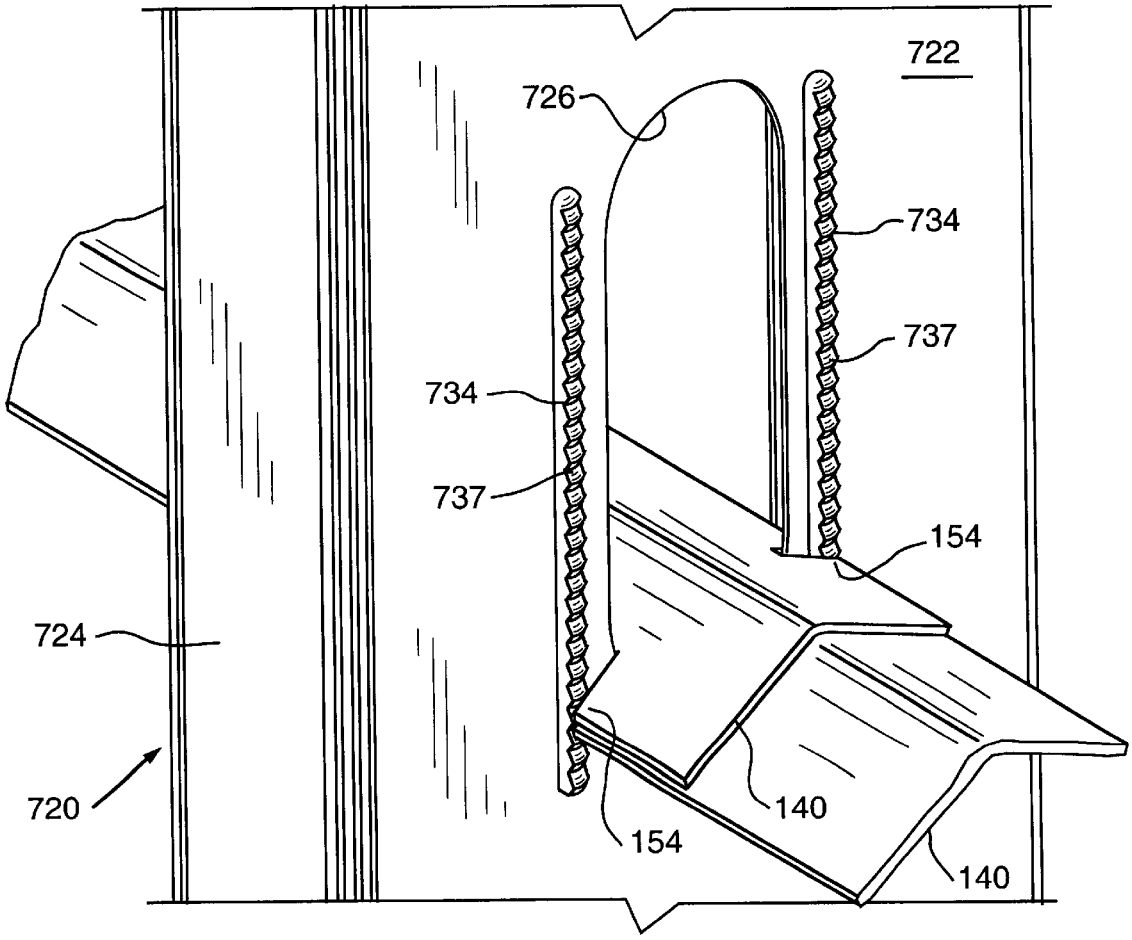
FIG. 39 is a partial perspective view of a pair of overlapping spacer members and the structural stud depicted in FIG. 37.

If desired, a pair of spacer bars 140 may be overlapped as shown in FIG. 39. In that embodiment, the spacer retainers 734 may be located for retaining engagement with the barbs 154 of both of the spacer bars 140.

Figure 40:
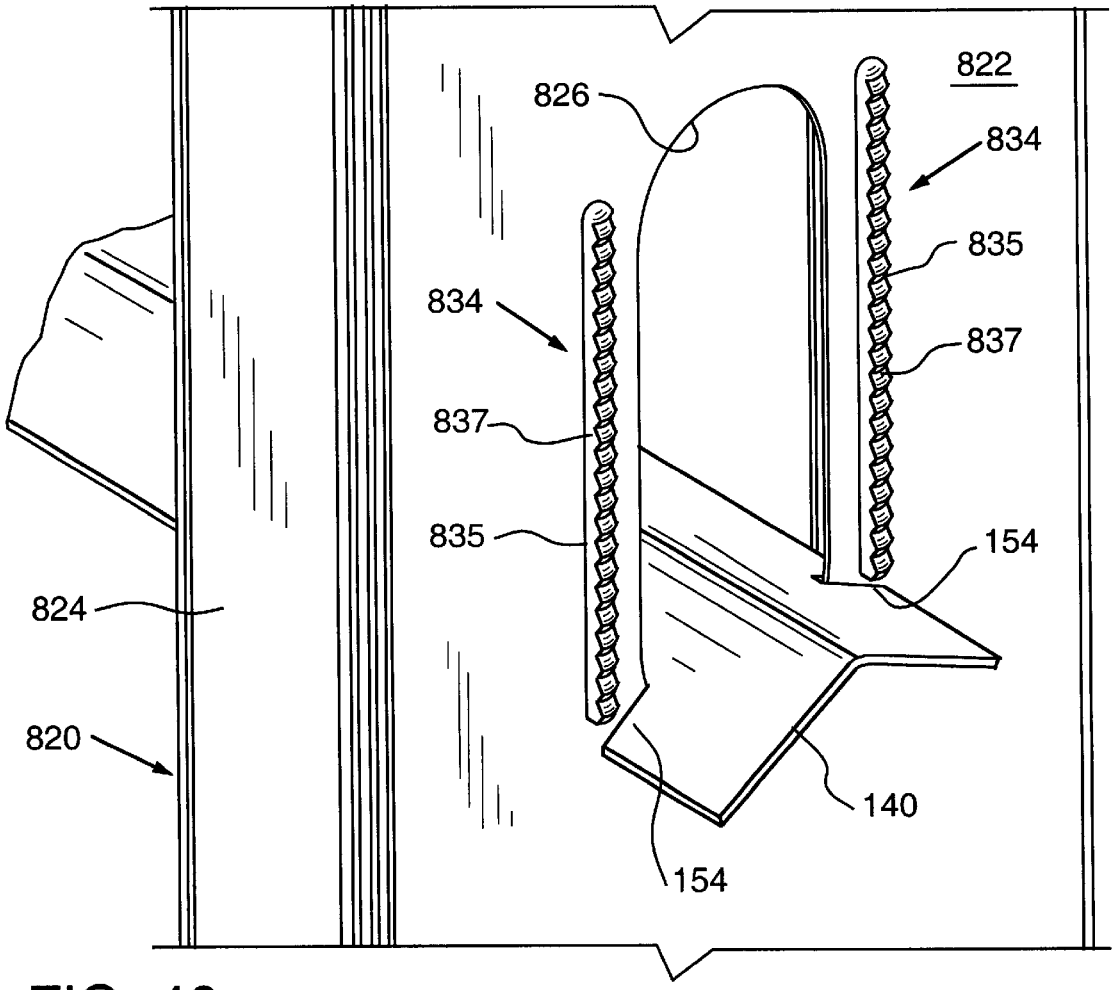
FIG. 40 is a partial perspective view of a spacer member and another structural stud of the present invention.

In the embodiment depicted in FIG. 40, the stud 820 is identical in construction when compared to stud 720. In particular, stud 820 has a web 822 that has an opening 826 therethrough and at least one and preferably two spacer retainers 834 in the form of elongated dimples 835 provided in the shape of a quarter sphere. The dimples 835 may have serrations 837 therein and are oriented such that when the spacer bar 140 is installed as shown (i.e., in seated engagement within the lower portion of the opening 826) the barbs 154 are not in engagement with the spacer retainers 834, but instead engage portions of the web 822 beneath the spacer retainers 834. In this embodiment, the spacer bar 140 is moved downwardly into the lower portion of the opening 826, by tapping the spacer bar 140 into position. The width of the notch 142 must be sufficient to permit the bar to be biased over the spacer retainers 834 when the bar 140 is being installed. Once installed in the position as shown in FIG. 40, the spacer retainers 834 would retard the inadvertent upward movement (direction represented by arrow "D") to prevent the removal of the spacer bar 140 from the stud 820. The elongated dimples 835 may be integrally formed in the web 822 or otherwise attached thereto by the various methods and mediums described above. In addition, dimples 835 protrude the same distance from the web 822 as the dimples 735 protrude from web 722 as described above.

Figure 41:
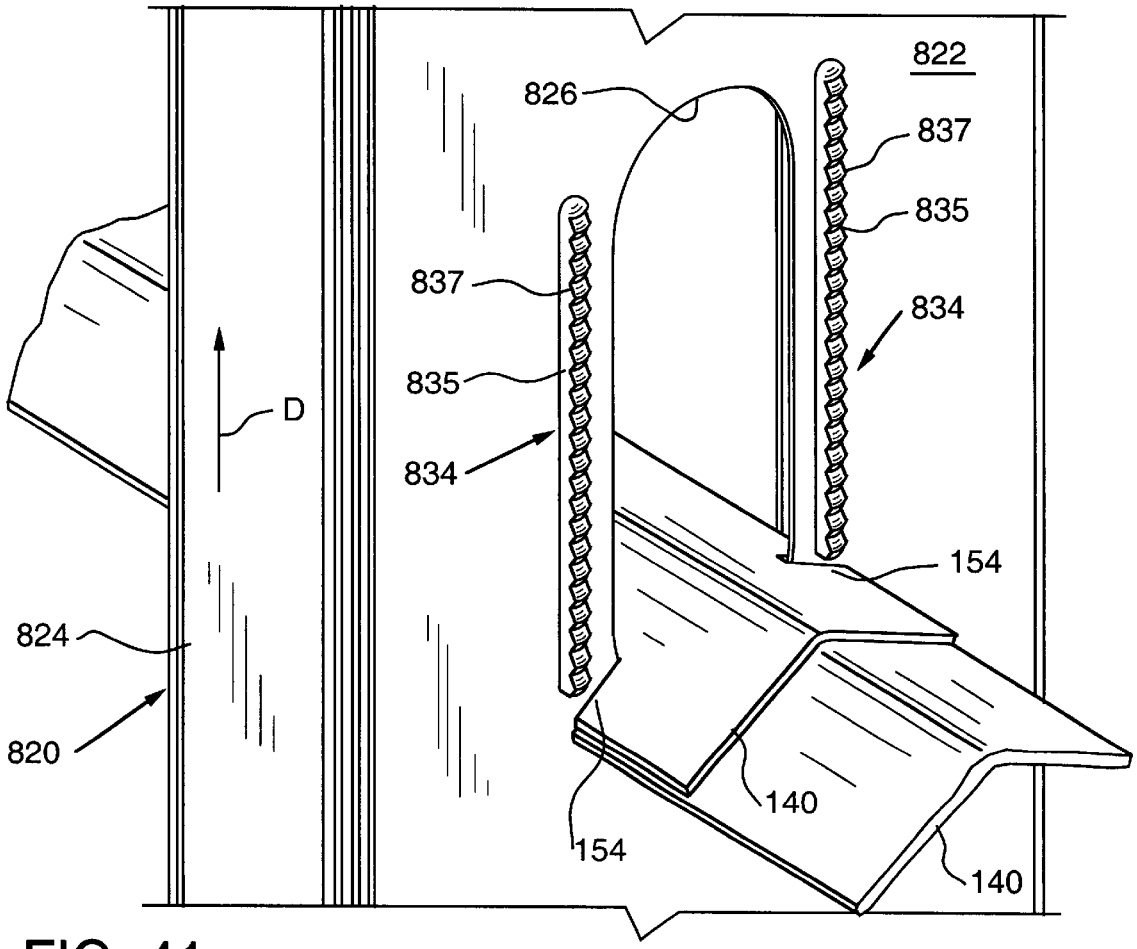
FIG. 41 is a partial perspective view of a pair of overlapping spacer members and the structural stud depicted in FIG. 40.

If desired, a pair of spacer bars 140 may be overlapped as shown in FIG. 41. In that embodiment, the spacer retainers 834 may be located for retaining engagement with the barbs 154 of both of the spacer bars 140.

Although the invention has been shown and described with respect to several embodiments, it will be apparent that equivalent alterations and modifications will occur to others skilled in the art upon the reading and understanding of this specification. The present invention includes all such equivalent alterations and modifications, and is limited only by the scope of the following claims.

What is claimed is:

1. A wall, comprising:

at least two studs wherein each said stud has a web with an opening therethrough;

an elongated spacer member extending through said opening in said webs of at least two said studs;

at least one stud engager on said elongated spacer member corresponding to each said web; and at least one spacer retainer on each said web in retaining engagement with a corresponding said stud engager on said elongated spacer member, wherein said at least one spacer retainer comprises a nonplanar dimple protruding from said web such that said dimple is not coplanar with said web from which it protrudes.

2. The wall of claim 1 wherein at least one said spacer retainer is integrally formed in said web.

3. The wall of claim 2 wherein said spacer retainers are located adjacent to each said opening through which said elongated spacer member extends.

4. The wall of claim 3 wherein said openings through said webs each have two spaced lateral sides and herein at least one said spacer retainer is located adjacent to one said lateral side of said opening and wherein at least one other said spacer retainer is located adjacent to the other said lateral side of said opening.

5. The wall of claim 3 wherein said opening through each said web has an upper end and a lower end and wherein at least one spacer retainer is located adjacent to said upper end of said opening an at least one spacer retainer is located adjacent to said lower end of said opening.

6. The wall of claim 1 wherein at least one said spacer retainer comprises a dimple formed in said web.

7. The wall of claim 1 wherein at least one said dimple is elongated.

8. The wall of claim 7 wherein at least one said elongated dimple has a plurality of serrations therein.

9. The wall of claim 1 wherein at least one said spacer retainer comprises at least one series of stacked dimples attached to said web adjacent said opening.

10. The wall of claim 9 wherein said stacked dimples comprise a plurality of dimples each having a quarter-spherical shape.

11. The wall of claim 1 wherein at least one said stud engager comprises a notch in said spacer ember, one side of said notch forming a resiliently biasable flap.

12. The wall of claim 1 wherein at least one said stud engager comprises a notch in said spacer ember, wherein one side of said notch forms a barb.

13. The wall of claim 1 further comprising another elongated spacer member extending through at leas one opening through which said elongated spacer member extends, said another elongated spacer member having at least one other stud engager thereon for engaging said spacer retainers adjacent the openings through which said another spacer member extends.

14. A wall, comprising:

at least two studs wherein each said stud has a web with an opening therethrough;

an elongated spacer member extending through said opening in said webs of at least two said studs;

at least one stud engager on said elongated spacer member corresponding to each said web and in retaining engagement therewith; and at least one spacer retainer formed on each said web for retaining said spacer member within said openings in said studs tough which said spacer member extends, wherein said at least one spacer retainer comprises a nonplanar dimple protruding from said web such that said dimple is not coplanar with said web from which it protrudes.

15. The wall of claim 14 wherein said spacer retainers correspond to said stud engagers on said spacer ember and do not engage said corresponding stud engagers of said spacer member when said stud engagers engage said webs.

16. The wall of claim 14 wherein at least one dimple is formed in said web.

17. The wall of claim 14 wherein at least one said dimple is elongated.

18. The wall of claim 17 wherein at least one said elongated dimple has a plurality of serrations therein.

19. The wall of claim 14 wherein at least one said spacer retainer comprises a series of serrations formed on each said web adjacent said opening therein.

20. A wall, comprising:

a bottom track;

at least two drywall studs, each said drywall stud having a web with at least one opening therethrough, said opening having an upper portion and a lower portion, said lower portion having two lateral sides, said drywall studs affixed to said bottom track such that the at least one opening in the web of one said drywall stud is in alignment with an opening in the web of another said drywall stud;

at least one elongated spacer member extending through the bottom portions of at least two aligned openings in the webs of said drywall studs, each said elongated spacer member having at least one flap formed therein corresponding to the web openings through which said elongated spacer member extends; and a nonplanar dimple protruding from the web of each said stud such that said dimple is not coplanar with said web from which it protrudes and being said oriented adjacent to said lower portion of said opening therein for retaining engagement with a corresponding said flap in said spacer member.

21. The wall of claim 20 wherein said dimples are integrally formed on said webs of said drywall studs.

22. The wall of claim 20 wherein said dimples are attached to said webs of said drywall studs.

23. The wall of claim 20 wherein one said dimple is located adjacent each said lateral side of said lower portion of each said opening.

24. A wall, comprising:

a bottom track;

at least two structural studs each having a web with at least one opening therethrough, said opening having an upper end and a lower end, said structural studs affixed to said bottom track such that the at least one opening in the web of one said structural stud is in alignment with an opening in the web of another said structural stud;

at least one elongated spacer member extending through the bottom end of at least two aligned openings in the webs of said structural studs, each said elongated spacer member having at least one notch formed therein corresponding to the web openings through which said elongated spacer member extends; and a nonplanar dimple protruding from the web of each said stud such that said dimple is not coplanar with said web from which it protrudes and being oriented adjacent to said lower end of said opening therein for retaining engagement with a corresponding said notch in said spacer member.

25. The wall of claim 24 further comprising at least one other dimple on each said web adjacent the upper end of the opening therein.

26. The wall of claim 24 wherein each said spacer member has two notches therein corresponding to the web openings through which said spacer member extends and further comprising two said dimples on each said web adjacent said bottom portion of said opening therein, each said dimple corresponding to one said notch in said spacer member.

27. The wall of claim 26 further comprising additional dimples formed adjacent said upper end of said opening in each said web.

28. A wall, comprising:

a bottom track;

at least two structural stud each having a web with at least one opening therethrough, said opening having two lateral sides, said structural studs affixed to said bottom track such that at least one opening in the web of one said structural stud is in alignment with an opening in the web of another said structural stud;

at least one elongated spacer member extending through the bottom end of at least two aligned openings in the webs of said structural studs, each said elongated spacer member having at least one notch formed therein corresponding to the web openings through which said elongated spacer member extends; and an elongated nonplanar dimple protruding from at least one said web such that said dimple is not coplanar with said web from which it protrudes and being adjacent each lateral side of said opening therein for retaining engagement with a corresponding said notch in said spacer member.

29. The wall of claim 28 wherein each said elongated dimple has a plurality of serrations therein.

30. A method for constructing a wall, comprising:

affixing at least two studs each having a web portion with at least one opening therethrough to a track such that at east one opening in the web of one stud is aligned with an opening in at least one other stud;

inserting a spacer member through at least two aligned openings; and engaging the spacer member with at least one dimple non-movably protruding from each of the webs of the stud through which the spacer member extends wherein each said dimple is not coplanar with said web from which it protrudes.

31. A method for constructing a wall, comprising:

affixing the lower end of a first stud to a track, the first stud having a web with at least one opening therethrough;

affixing an upper end of a second stud to the track such that an opening in a web of the second stud is in alignment with the opening in the web of the first stud;

inserting a spacer member through the aligned openings in the first and second studs; and engaging the spacer member with at least one dimple non-movably protruding from each of the webs of the first and second studs such that each said dimple is not coplanar with said web from which it protrudes.

32. A wall, comprising:

at least two studs wherein each said stud has a web with an opening therethrough;

an elongated spacer member extending through said opening in said webs of at least two said studs;

at least one stud engager on said elongated spacer member corresponding to each said web; and at least one spacer retainer n each said web in retaining engagement with a corresponding said stud engager on said elongated spacer member, wherein said at least one spacer retainer comprises at least one series of stacked dimples attached to said web adjacent said opening.

33. A wall, comprising:

a bottom track;

at least two structural stud each having a web with at least one opening therethrough, said opening having an upper end and a lower end, said structural studs affixed to said bottom track such that the at least one opening in the web of one said structural stud is in alignment with an opening in the web of another said structural stud;

at least one elongated spacer member extending through the bottom end of at least two aligned openings in the webs of said structural studs, each said elongated spacer member having at least one notch formed therein corresponding to the web openings though which said elongated spacer member extends;

a dimple on the web of each said stud and oriented adjacent to said lower end of said opening therein for retaining engagement with a corresponding said notch in said spacer member, wherein each said dimple comprises at least one series of stacked dimples attached to said web adjacent said opening.

34. A wall, comprising:

at least two studs wherein each said stud has a web with an opening therethrough;

an elongated spacer member extending through said opening in said webs of at least two said studs;

at least one stud engager on said elongated spacer member corresponding to each said web; and at least one spacer retainer on each said web in retaining engagement with a corresponding said stud engager on said elongated spacer member, wherein said at least one spacer retainer comprises a nonplanar hemispherically shaped dimple protruding from said web.

35. A wall, comprising:

at least two studs wherein each said stud has a web with an opening therethrough;

an elongated spacer member extending through said opening in said webs of at least two said studs;

at least one stud engager on said elongated spacer member corresponding to each said web; and at least one spacer retainer on each said web in retaining engagement with a corresponding said stud engager on said elongated spacer member, wherein said at least one spacer retainer comprises a nonplanar dimple protruding from said web, each said nonplanar dimple having a quarter spherical shape.

36. A wall, comprising:

at least two studs wherein each said stud has a web portion with an opening therethrough;

an elongated spacer member extending through said opening in said webs of at least two said studs;

at least one stud engager on said elongated spacer member corresponding to each said web and in retaining engagement therewith; and at least one spacer retainer formed on each said web for retaining said spacer member within said openings in said studs through which said spacer member extends, wherein said at least one spacer retainer comprise a nonplanar hemispherically shaped dimple protruding from said web.

37. A wall, comprising:

at least two studs wherein each said stud has a web portion with an opening therethrough;

an elongated spacer member extending through said opening in said webs of at least two said studs;

at least one stud engager on said elongated spacer member corresponding to each said web and in retaining engagement therewith; and at least one spacer retainer formed on each said web for retaining said spacer member within said openings in said studs through which said spacer member extends, wherein said at least one spacer retainer comprise a nonplanar dimple protruding from said web, each said nonplanar dimple having a quarter spherical shape.

38. A wall, comprising:

a bottom track;

at least two structural stud each having a web with at least one opening therethrough, said opening having an upper end and a lower end, said structural studs affixed to said bottom track such that the at least one opening in the web of one said structural stud is in alignment with an opening in the web of another s id structural stud;

at least one elongated spa r member extending through the bottom end of at least two aligned openings in the webs of s id structural studs, each said elongated spacer member having at least one notch formed therein corresponding to the web openings through which said elongated spacer member extends; and a nonplanar hemispherically shaped dimple protruding from the web of each said stud and oriented adjacent to said lower end of said opening therein for retaining engagement with a corresponding said notch in said spacer member.

39. A wall, comprising:

a bottom track;

at least two structural stud each having a web with at least one opening therethrough, said opening having an upper end and a lower end, said structural studs affixed to said bottom track such that the at least one opening in the web of one said structural stud is in alignment with an opening in the web of another said structural stud;

at least one elongated spacer member extending through the bottom end of at least two aligned openings in the webs of said structural studs, each said elongated spacer member having at least one notch formed therein corresponding to the web openings through which said elongated spacer member extends; and a nonplanar dimple protruding from the web of each said stud and oriented adjacent to said lower end of said opening therein for retaining engagement with a corresponding said notch in said spacer member, at least one said nonplanar dimple having a quarter spherical shape.

40. A wall, comprising:

a bottom track;

at least two structural stud each having a web with at least one opening therethrough, said opening having an upper end and a lower end, said structural studs affixed to said bottom track such that the at least one opening in the web of one said structural stud is in alignment with an opening in the web of another said structural stud;

at least one elongated spacer member extending through the bottom end of at least two aligned openings in the webs of said structural studs, each said elongated spacer member having at least one notch formed therein corresponding to the web openings through which said elongated spacer member extends; and a nonplanar dimple protruding from the web of each said stud and oriented adjacent to said lower end of said opening therein for retaining engagement with a corresponding said notch in said spacer member and wherein each said dimple comprises at least one series of stacked dimples attached to said web adjacent said opening.

41. The wall of claim 40 wherein said stacked dimples comprise a plurality of dimples each having a quarter-spherical shape.

42. The wall of claim 40 wherein each said dimple has a hemispherical shape.

* * * * *

UNITED STATES PATENT AND TRADEMARK OFFICE

CERTIFICATE OF CORRECTION

PATENT NO. : 6,694,695 B2 
DATED : February 24, 2004
INVENTOR(S) : John J. Collins, Larry R. Daudet and Gregory S. Ralph It is certified that error appears in the above-identified patent and that said Letters Patent is hereby corrected as shown below:

Title page,
Item [57], ABSTRACT,
Line 3, delete "having" and replace therewith -- have --.

Column 1,
Line 54, delete "rack" and replace therewith -- track --.

Column 3,
Line 10, delete "a" and replace therewith -- at --.

Column 7,
Line 34, delete "to fit within the dimensioned".

Column 10,
Line 24, delete "14" and replace therewith -- 220 --.
Line 38, delete "150. AT" and replace therewith -- 150, at --.
Line 49, after "stud", delete ",".

Column 11,
Line 14, delete "barb" and replace therewith -- barbs --.

Column 12,
Line 8, delete "for-example" and replace therewith -- for example --.

Column 15,
Line 67, delete "herein" and replace therewith -- wherein --.

Column 16,
Line 9, delete "an" and replace therewith -- and --.
Lines 23, 26 and 51, delete "ember" and replace therewith -- member --.
Line 30, delete "leas" and replace therewith -- least --.
Line 46, delete "tough" and replace therewith -- through --.

Column 17,
Line 14, delete "said".
Line 62, delete "stud" and replace therewith -- studs --.

UNITED STATES PATENT AND TRADEMARK OFFICE

CERTIFICATE OF CORRECTION

PATENT NO. : 6,694,695 B2 
DATED : February 24, 2004
INVENTOR(S) : John J. Collins, Larry R. Daudet and Gregory S. Ralph It is certified that error appears in the above-identified patent and that said Letters Patent is hereby corrected as shown below:

Column 18,
Line 18, delete “east” and replace therewith -- least --.
Line 48, delete “n” and replace therewith -- on --.
Line 55, delete “stud” and replace therewith -- studs --.
Line 66, delete “extends;” and replace therewith -- extends; and --.

Column 19,
Lines 45 and 59, delete “comprise” and replace therewith -- comprises --.

Column 20,
Line 3, delete “s id”, replace therewith -- said --.
Line 5, delete “spa r”, and replace therewith -- spacer --.
Line 7, delete “s id”, and replace therewith -- spacer --.
Lines 19 and 41, delete “stud” and replace therewith -- studs --.

Signed and Sealed this

Third Day of August, 2004

JON W. DUDAS
*Acting Director of the United States Patent and Trademark Office*